US006860317B2

(12) United States Patent
Kim et al.

(10) Patent No.: US 6,860,317 B2
(45) Date of Patent: Mar. 1, 2005

(54) METHOD AND APPARATUS FOR PRODUCING URANIUM FOIL AND URANIUM FOIL PRODUCED THEREBY

(75) Inventors: Chang-Kyu Kim, Daejeon-Si (KR); Ki-Hwan Kim, Daejeon-Si (KR); Seok-Jin Oh, Daejeon-Si (KR); Se-Jung Jang, Daejeon-Si (KR); Eung-Soo Kim, Daejeon-Si (KR)

(73) Assignee: Korea Atomic Energy Research Institute, Daejeon-Si (KR)

( * ) Notice: Subject to any disclaimer, the term of this patent is extended or adjusted under 35 U.S.C. 154(b) by 149 days.

(21) Appl. No.: 10/393,978

(22) Filed: Mar. 24, 2003

(65) Prior Publication Data

US 2003/0159795 A1 Aug. 28, 2003

Related U.S. Application Data

(63) Continuation-in-part of application No. 09/836,478, filed on Apr. 18, 2001, now abandoned.

(30) Foreign Application Priority Data

Oct. 31, 2000 (KR) ..... 00-64237

(51) Int. Cl.[7] ..... B22D 11/113

(52) U.S. Cl. ..... 164/480; 164/471; 164/474; 164/475; 164/479; 164/427; 164/428; 164/438

(58) Field of Search ..... 164/471, 474, 164/475, 478–480, 485, 427, 428, 438, 443

(56) References Cited

U.S. PATENT DOCUMENTS

| | | | | |
|---|---|---|---|---|
| 3,010,890 A | | 11/1961 | Jepson et al. | |
| 3,285,737 A | | 11/1966 | Bellamy | |
| 3,724,529 A | * | 4/1973 | Chaulet et al. | 164/155.4 |
| 3,888,300 A | | 6/1975 | Guichard et al. | |
| 3,969,160 A | | 7/1976 | Hemperly | |
| 4,154,283 A | | 5/1979 | Ray et al. | |
| 4,577,081 A | | 3/1986 | Balzer | |
| 4,714,104 A | | 12/1987 | Ouchi et al. | |
| 4,982,780 A | | 1/1991 | Stepanenko et al. | |
| 5,720,336 A | | 2/1998 | Strezov | |
| 5,960,865 A | | 10/1999 | Blejde et al. | |
| 6,793,005 B2 | * | 9/2004 | Lee et al. | 164/415 |

FOREIGN PATENT DOCUMENTS

JP 362077151 A 4/1987

* cited by examiner

*Primary Examiner*—Kiley S. Stoner
*Assistant Examiner*—Kevin McHenry
(74) *Attorney, Agent, or Firm*—Arent Fox, PLLC

(57) ABSTRACT

Disclosed are a method and an apparatus for producing a uranium foil with fine crystalline granules by forming the foil by the gravitational dropping of molten uranium or uranium alloy and rapidly cooling the foil by the contact with cooling rolls, and a foil produced thereby. In accordance with the present invention, a high-purity and high-quality uranium foil with an isotropic structure and fine crystalline granules is easily produced via a simple process without requiring hot rolling and heat treatment processes. The surface of the foil is prevented from oxidizing and residual stress is not imparted to the foil. The productivity and the economic efficiency of the foil are improved.

29 Claims, 20 Drawing Sheets

METHOD AND APPARATUS FOR PRODUCING URANIUM FOIL AND URANIUM FOIL PRODUCED THEREBY

This is a continuation-in-part of application Ser. No. 09/836,478 filed Apr. 18, 2001 abandoned. The disclosure of the prior application is hereby Incorporated by reference herein in its entirety.

BACKGROUND OF THE INVENTION

1. Field of the Invention

The present invention relates to a method and an apparatus for producing a uranium foil with fine crystalline granules by forming the foil by the gravitational dropping of molten uranium or uranium alloy and then rapidly cooling the foil by the contact with cooling rolls, and a foil produced thereby.

More particularly, the present invention relates to a method and an apparatus for easily producing a high-purity and high-quality uranium foil having a fine isotropic structure without requiring hot rolling and heat treatment processes, in which the surface of the foil is prevented from oxidizing and residual stress is not imparted to the foil, and a foil produced thereby, thus improving the productivity and the economic efficiency of the production process.

2. Description of the Related Art

Known in the art are several methods and apparatus for producing a uranium foil, as follows.

U.S. Pat. No. 3,010,890 discloses a method for producing uranium alloy with fine particles by alpha-annealing and beta-quenching. Since the uranium alloy is produced by heat treatment and rolling processes, such a method has a problem of imparting residual stress.

The method disclosed by U.S. Pat. No. 3,285,737 also employs heat treatment and rolling processes in alpha-annealing and beta-quenching, thereby having the same problem of imparting residual stress.

U.S. Pat. No. 3,888,300 discloses an apparatus for continuously casting metals and metal alloys under the vacuum condition, in which rolls are located within a suction chamber separated by diaphragm walls, and molten metal is guided and discharged into the suction chamber under the proper vacuum state.

U.S. Pat. No. 3,969,160 discloses a high-strength ductile uranium alloy consisting titanium, vanadium, and uranium, which possess desirable ductility while retaining the anti-corrosion characteristics of titanium.

U.S. Pat. No. 4,154,283 discloses a process for producing metal alloy noncrystalline filaments having improved surface characteristics and enhanced mechanical properties using a quenching wheel in a partial vacuum.

U.S. Pat. No. 4,577,081 discloses a method and an apparatus for heating a billet of nonmagnetic metal material to a forging temperature and reheating the billet using an inductive heating coil.

U.S. Pat. No. 4,714,104 discloses an apparatus for continuously casting a metal, in which the metal is degassed under vacuum, thereby preventing the fluctuation of molten metal at the surface of the metal.

U.S. Pat. No. 4,982,780 discloses a method for producing a noncrystalline metal filament with a uniform thickness, in which a width of the filament is varied by the rotational directions of a chill.

U.S. Pat. No. 5,720,336 discloses a method for continuously casting a metal strip, in which a casting pool is created above a pair of parallel casting rolls engaged with each other, and molten metal is fed into the nip between the casting rolls.

U.S. Pat. No. 5,960,856 discloses a method and an apparatus for casting a metal strip including iron, in which a casting pool of molten metal is supported on a pair of casting rolls, the molten metal is cast into the strop by moving downward from a nip between the casting rolls, and the cast metal strip is completely cooled by means of non-contact heat absorbers.

Further, in a method for producing a uranium foil known to the skilled in the art, an ingot is made of uranium or uranium alloy, cut, and then fed through the hot rolling process, thereby being formed into the foil.

More specifically, the ingot is maintained at a constant temperature of 1,300° C. and then cast into a sheet in a vacuum inductive melting furnace. Otherwise, the ingot is cut into sheets with a proper size, and then the cut sheets repeatedly go through hot rolling and heat treatment processes at a temperature of 600° C. under the inert gas atmosphere so that the thickness of the sheet is gradually reduced. Finally, a uranium foil with a thickness of 100 $\mu$m to 500 $\mu$m is produced.

In order to prevent the swelling of the uranium foil during the irritation test, an isotropic structure of the foil having fine crystalline granules of the foil is required. Such isotropic structure of the foil is obtained by the heating process at 800° C. and subsequently the quenching process.

Therefore, the conventional method for producing the uranium foil is very complicated and troublesome.

Moreover, since the uranium or uranium alloy retains rigidity while lacking ductility, the hot rolling of the uranium or uranium alloy is very difficult.

During the rolling process, the residual stress existing in the uranium causes cracks in the foil, thereby producing defective foils and reducing the recovery rate of the uranium.

Therefore, the conventional method for producing the uranium foil with the reduced recovery rate is noneconomical.

Since uranium is an easily oxidizable material, the uranium must go through the hot rolling process under a vacuum condition or an inert gas atmosphere. Accordingly, the repetition of the hot rolling processes of the uranium is very troublesome, requires a long period of time, and remarkably reduces the productivity of the uranium foil.

The produced uranium foil having residual stress due to the repetition of the hot rolling process may be deformed or damaged due to such thermal cycling during the production or the irradiation.

The method for producing uranium foil by the hot rolling process further requires an additional process for removing impurities such as a surface-oxidized product mixed at the rolling process, thereby being complicated.

SUMMARY OF THE INVENTION

Therefore, the present invention has been made in view of the above problems, and it is an object of the present invention to provide a method and an apparatus for easily producing a high-purity and high-quality uranium foil via a simple process without requiring hot rolling and heat treatment processes, in which the surface of the foil is prevented from oxidizing and residual stress is not imparted to the foil, thereby improving the productivity and the economic efficiency of the production of the foil.

It is a further object of the present invention to provide a method and an apparatus for continuously producing a uranium foil with enhanced characteristics, a uniform thickness and a broad width, in which molten metal is retained in a furnace by reducing the pressure within the furnace and increasing the pressure within a chamber, the molten metal is discharged to the outer circumference of a cooling roll and formed into the foil via a slot of the furnace under the condition that the slot is located close to the cooling roll, and the foil is rapidly cooled by the contact with the cooling roll so that fine crystalline granules of the uranium foil with irregular orientation are formed.

It is another object of the present invention to provide a method and an apparatus for producing a uranium foil with rigidity without requiring the rolling process.

It is still another object of the present invention to provide a method and an apparatus for mass-producing a uranium foil with excellent characteristic in a short period of time, in which the recovery rate of the uranium is increased.

It is yet another object of the present invention to provide a method and an apparatus for producing a uranium foil without imparting residual stress to the foil.

It is still yet another object of the present invention to provide a uranium foil with an isotropic structure, in which fine crystalline granules having different orientation are irregularly disposed.

In accordance with one aspect of the present invention, the above and other objects can be accomplished by the provision of a method for producing a uranium foil, comprising the steps of:

(a) charging a furnace installed in a sealed chamber with uranium alloy, forming a vacuum in the chamber, and heating the chamber by means of a high frequency induction coil so that the uranium alloy is melted in the chamber;

(b) elevating a stopper installed in the furnace so that the molten uranium alloy is discharged from the furnace into a turn dish below the furnace, and gravitationally dropping the molten uranium alloy as a foil shape at a designated speed via a slot of a nozzle installed in a bottom surface of the turn dish;

(c) feeding the foil into a gap between a pair of cooling rolls located below the slot within the chamber and rotated in opposite directions so that both sides of the foil respectively contact the cooling rolls to be rapidly cooled; and (d) collecting the cooled foil by a collection tray located below the cooling rolls at a bottom of the chamber.

In accordance with a further aspect of the present invention, there is provided an apparatus for producing a uranium foil, comprising:

a vacuum unit including:

a hermetically sealed chamber;

an exhaust pump installed at the outside of the chamber; and an exhaust pipe for connecting the chamber and the exhaust pump, the vacuum unit serving to form a vacuum state in the chamber;

a melting and discharging unit including:

a furnace installed within the chamber;

a high frequency induction coil wound around an outer surface of the furnace;

an outlet formed through a bottom of the furnace; and a stopper moving upward and downward so as to open and close the outlet, the melting and discharging unit serving to melt uranium alloy and discharge molten uranium alloy;

a foil forming unit including:

a turn dish located below the furnace correspondingly to the outlet;

a nozzle installed in a bottom of the turn dish; and a slot formed through an end of the nozzle, the foil forming unit serving to cast the molten uranium alloy uniformly supplied from the turn dish into the foil via the slot and to allow the cast foil to be gravitationally dropped at a designated speed;

a contact cooling unit including:

a pair of cooling rolls located below the slot within the chamber and operated at a designated speed so that both sides of the foil cast by the slot respectively contact the two cooling rolls to rapidly cool the foil; and a collection tray located below the cooling rolls at a bottom of the chamber.

In accordance with another aspect of the present invention, there is provided a method for producing a uranium foil, comprising the steps of:

(a) charging a furnace provided with a nozzle in its bottom with uranium alloy, and heating the furnace under the vacuum condition;

(b) breaking the vacuum in a chamber before the uranium alloy is melted, and filling the chamber and the furnace with an inert gas until the chamber and the furnace reach designated pressures;

(c) sealing the furnace after the chamber and the furnace is completely filled with the inert gas, and additionally injecting inert gas into the chamber so that the chamber has a higher pressure than the furnace to generate a counterpressure in the furnace;

(d) continuously heating the uranium alloy during the maintaining of the counterpressure so as to form completely molten uranium alloy with a designated temperature, and moving the furnace downward so that a slot approaches the outer circumference of a cooling roll rotated at a designated speed;

(e) injecting inert gas into the furnace so that the counterpressure in the furnace is broken after the slot approaches the cooling roll, and discharging the molten uranium alloy to the outer circumference of the cooling roll at a uniform pressure via the slot so as to cast the molten uranium alloy into a foil via the slot;

(f) rotating the cooling roll and the foil thereon so that the foil is rapidly cooled after one side of the foil formed from the molten uranium alloy discharged via the slot contacts the outer circumference of the cooling roll; and (g) feeding the cooled and solidified foil into a collection tray located close to the cooling roll.

In accordance with yet another aspect of the present invention, there is provided an apparatus for producing a uranium foil, comprising:

a vacuum unit including:

a hermetically sealed chamber;

an exhaust pump installed at the outside of the chamber; and an exhaust pipe for connecting the chamber and the exhaust pump, the vacuum unit serving to form a vacuum state in the chamber;

a melting and discharging unit including:

a furnace installed within the chamber;

a nozzle integrally formed at a bottom of the furnace;

a slot formed at an end of the nozzle; and a high frequency induction coil wound around an outer surface of the furnace;

a contact cooling unit including a cooling roll positioned below the slot within the chamber and rotated at a designated speed so that one side of the foil formed from the molten uranium alloy discharged via the slot contacts the outer circumference of the cooling roll;

a moving unit for moving the furnace upward and downward so that the slot is close to the cooling roll;

a sealing unit located between the moving unit and the furnace for hermetically sealing and fixing the furnace;

a counterpressure generating unit including:

a gas feed pipe connected to the chamber and provided with a gas supply valve; and a furnace flow pipe connected to the chamber and the furnace via the sealing unit and provided with a switching valve; and a jetting unit including a gas injection pipe branched from the furnace flow pipe and provided with a gas injection valve.

BRIEF DESCRIPTION OF THE DRAWINGS

The above and other objects, features and other advantages of the present invention will be more clearly understood from the following detailed description taken in conjunction with the accompanying drawings, in which:

FIG. 3*a* is an enlarged longitudinal-sectional view of the apparatus, illustrating the melting of uranium alloy under the vacuum condition;

FIG. 3*b* is an enlarged longitudinal-sectional view of the apparatus, illustrating the discharging of molten uranium alloy;

FIG. 3*c* is an enlarged longitudinal-sectional view of the apparatus, illustrating the forming of a foil;

FIG. 3*d* is an enlarged perspective view of the apparatus, illustrating the forming of the foil; and FIG. 3*e* is an enlarged longitudinal-sectional view of the apparatus, illustrating the cooling of the foil using gas;

FIG. 7*a* is an enlarged longitudinal-sectional view of the apparatus, illustrating the melting of uranium alloy under the vacuum condition;

FIG. 7*b* is an enlarged longitudinal-sectional view of the apparatus, illustrating the filling of a chamber with inert gas;

FIG. 7*c* is an enlarged longitudinal-sectional view of the apparatus, illustrating the forming of counterpressure;

FIG. 7*d* is an enlarged longitudinal-sectional view of the apparatus, illustrating the discharging of molten uranium alloy when a slot approaches a cooling roll;

FIG. 7*e* is an enlarged view of a part "A" of FIG. 7*d*; and

FIG. 7*f* is an enlarged longitudinal-sectional view of the apparatus, illustrating the adjusting of the jetting angle of the molten uranium alloy;

DESCRIPTION OF THE PREFERRED EMBODIMENTS

Now, preferred embodiments of the present invention will be described in detail with reference to the annexed drawings.

Figure 1:
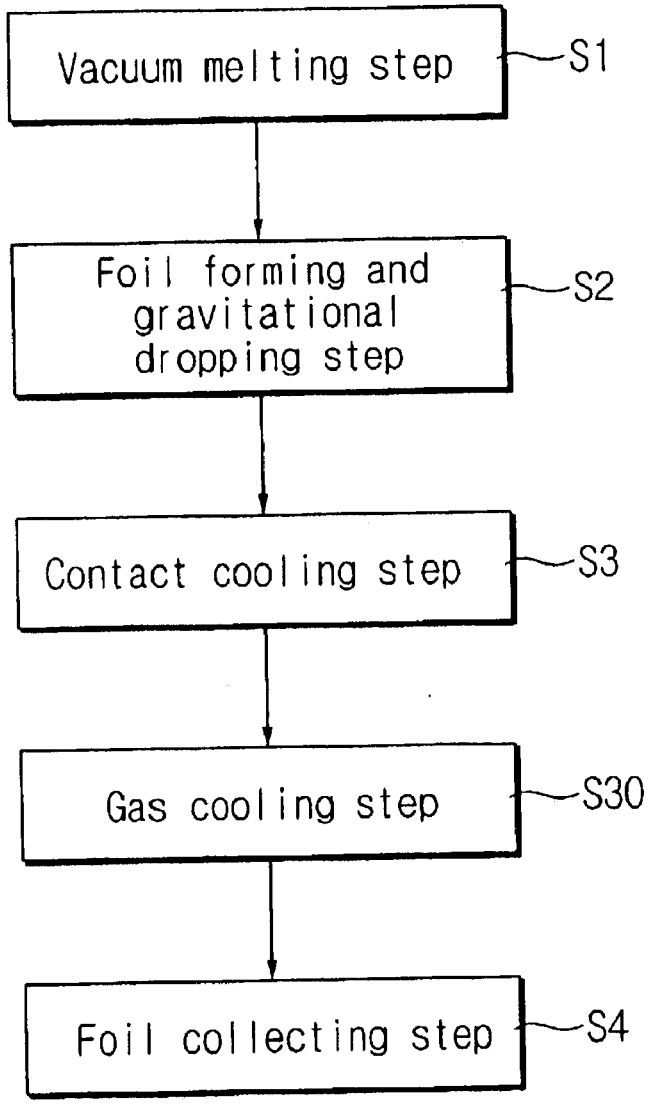
FIG. 1 is a block diagram illustrating a method for producing a uranium foil in accordance with a first embodiment of the present invention.

FIG. 1 is a block diagram illustrating a method for producing a uranium foil in accordance with a first embodiment of the present invention.

The method for producing the uranium foil in accordance with the first embodiment of the present invention comprises vacuum melting step (S1), foil forming and gravitational dropping step (S2), contact cooling step (S3), gas cooling step (S30), and foil collecting step (S4).

The above method for producing the uranium foil may be applied to uranium alloy as well as uranium. Particularly, the uranium alloy contains uranium and three elements (hereinafter, referred to as U-Q-X-Y). The Q, X, and Y elements are different ones selected from the group consisting of Al, Fe, Ni, Si, Cr, Zr, Mo, and Nb. The Q element is present in an amount of 0 to 10 wt. %, the X element is present in an amount of 0 to 1 wt. %, and the Y element is present in an amount of 0 to 1 wt. %.

More specifically, at vacuum melting step (S1), a furnace is installed within a hermetically sealed chamber and charged with uranium alloy. Then, the furnace is heated by a high frequency induction coil wound around the outer surface of the furnace so that the uranium alloy is melted under the vacuum condition.

When the uranium alloy is melted under the vacuum condition, the obtained molten uranium alloy is degassed. Preferably, the molten uranium alloy is superheated at a temperature higher than the melting temperature of the alloy by at least 200° C. so that the uranium alloy is completely melted.

Preferably, at vacuum melting step (S1), a degree of vacuum within the chamber is more than $10^{-2}$ torr to ensure that the molten uranium alloy is properly degassed.

At foil forming and gravitational dropping step (S2), a stopper installed within the furnace is elevated so that the molten uranium alloy is discharged from the furnace to a turn dish. Than, the molten uranium alloy is cast into a foil at a uniform speed, and simultaneously falls down via a slot of a nozzle installed through the bottom of the turn dish.

Here, the turn dish is located under the furnace and serves to supply the molten uranium alloy to the nozzle in a uniform rate, thereby allowing the molten uranium alloy to be cast into the foil and to gravitationally fall down.

Accordingly, the molten uranium alloy is cast into the foil with a uniform thickness via the slot, and simultaneously falls down gravitationally without any application of external force. That is, the molten uranium alloy is cast into the foil through the slot without the deformation of its crystalline structure.

Here, preferably, the width of the slot is in the range of 0 to 1.2 mm. In case that the width of the slot is not less than 1.2 mm, the surface of the produced foil may have irregularities to be not smooth, thereby increasing a defective proportion.

At contact cooling step (S3), the descending foil is fed into a gap between a pair of cooling rolls located below the slot in the chamber and rotated in opposite directions so that both sides of the foil respectively contact the cooling rolls, thereby being rapidly cooled down.

Here, the cooling rolls do not draw the foil, but serve only to contact the both sides of the foil to rapidly cool the foil.

Therefore, preferably, the rotational speed of the cooling roll is equal to the descending speed of the foil. In case that the rotational speed of the cooling rolls is lower or higher than the descending speed of the foil, when the both sides of the foil contact the cooling rolls, external force is transmitted from the cooling rolls to the foil, thereby having a rolling effect on the foil and imparting residual stress on crystalline granules of the foil.

Preferably, the rotational speed of the cooling rolls is in the range of 0 to 300 rpm. In case that the rotational speed of the cooling rolls is not less than 300 rpm, it is difficult to make the dropping speed of the foil via the slot to coincide with the rotational speed of the cooling rolls.

Further, preferably, at contact cooling step (S3), the cooling speed of the foil by means of the cooling rolls is more than $10^{3}$° C./sec. In case that the cooling speed of the foil is not more than $10^{3}$° C./sec, since the foil cannot be rapidly cooled, the produced uranium foil lacks fine crystalline granules.

By forming the foil via the slot and rapidly cooling the foil using the cooling rolls, it is possible to produce the uranium foil with a thickness in the range of 0 to 150 $\mu$m and fine polycrystalline granules.

At gas cooling step (S30), an inert gas is blown to the foil after the contact cooling using the cooling rolls, thereby completely cooling the foil under the inert gas atmosphere.

Here, the highly oxidizable uranium is completely cooled under the inert gas atmosphere. Accordingly, the gas cooling step (S30) serves as a subsidiary cooling step so as to more stably cool the foil.

At foil collecting step (S4), the cooled foil is dropped into the collection tray located below the cooling rolls at the bottom of the chamber.

In accordance with the above-described method for producing the uranium foil, the uranium alloy is melted within the sealed chamber, formed into the foil via the slot and simultaneously dropped gravitationally, and then rapidly contact-cooled without application of external force. Accordingly, it is possible to easily produce the high-quality and high-purity uranium foil without requiring a rolling or heat treatment process, thereby preventing defects due to impurities and residual stress.

Figure 2:
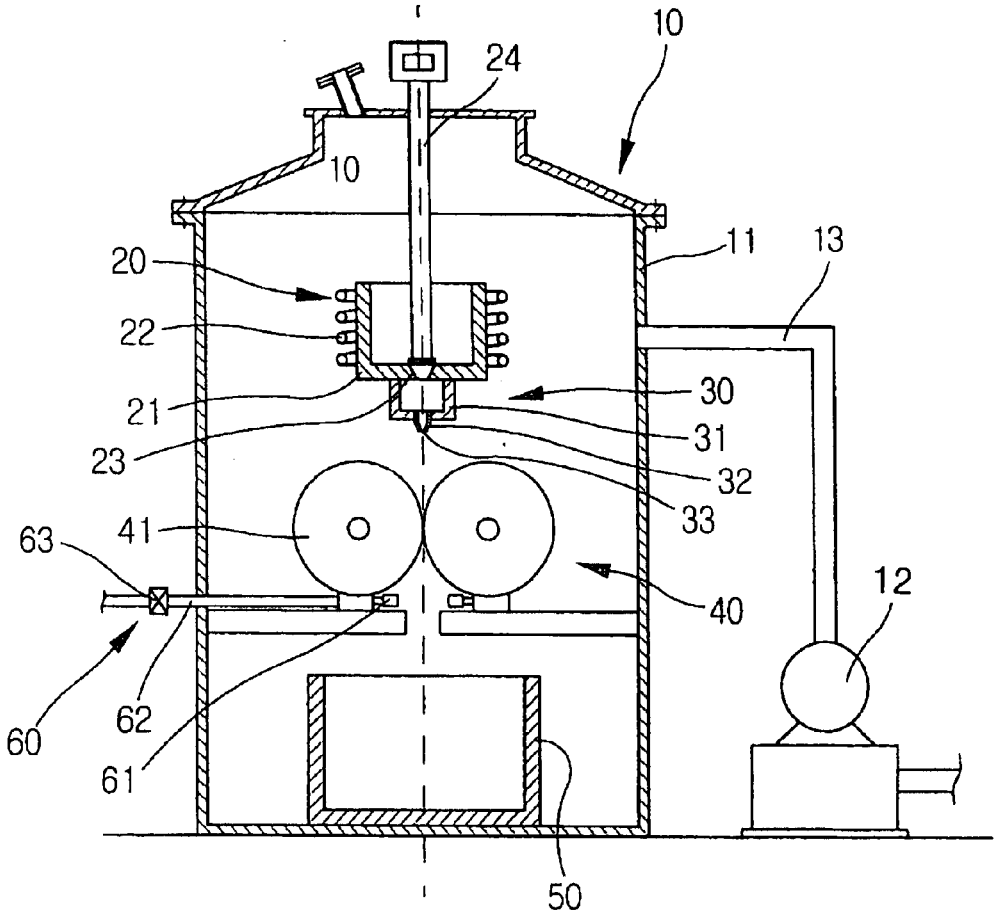
FIG. 2 is a schematic longitudinal-sectional view of an apparatus for producing a uranium foil in accordance with the first embodiment the present invention.

FIG. 2 is a schematic longitudinal-sectional view of an apparatus for producing a uranium foil in accordance with the first embodiment the present invention. With reference to FIG. 2, the apparatus is described, as follows.

The above apparatus for producing the uranium foil comprises a vacuum unit 10, a melting and discharging unit 20, a foil-forming unit 30, a contact cooling unit 40, a collection tray 50, and a gas-cooling unit 60. The vacuum unit 10 forms a vacuum in a chamber 11. The melting and discharging unit 20 is located within the chamber 11, and serves to melt uranium alloy and then to discharge the obtained molten uranium alloy. The foil-forming unit 30 serves to form a foil from the discharged molten uranium alloy. The foil formed by the foil-forming unit 30 is gravitationally dropped and contacts the contact cooling unit 40, thereby being cooled. The foil cooled by the contact cooling unit 40 is collected by the collection tray 50. The gas-cooling unit 60 is located between the contact cooling unit 40 and the collection tray 50, and serves to cool one more time the foil cooled by the contact cooling unit 40, with an inert gas.

More specifically, the vacuum unit 10 includes the hermetically sealed chamber 11, and an exhaust pump 12 located at the outside of the chamber 11 and connected to the chamber 11 by an exhaust pipe 13. Air within the chamber 11 is exhausted to the outside via the exhaust pipe 13 by the operation of the exhaust pump 12. Thus, the inside of the chamber 11 has a proper degree of vacuum.

The melting and discharging unit 20 includes a furnace 21, an outlet 23, a stopper 24. The furnace 21 is located within the chamber 11, and is wound with a high frequency induction coil 22. The outlet 23 is formed through the bottom of the furnace 21. The stopper 24 serves to open/close the outlet 23. The furnace 21 is heated by the high frequency induction coil 22, thereby melting the uranium alloy to form molten uranium alloy. The stopper 24 is lowered or elevated so as to open or close the outlet 23, thereby allowing the molten uranium alloy to be discharged or stopping the discharging of the molten uranium alloy.

Since the uranium alloy is melted under the vacuum condition of the chamber 11 of the melting and discharging unit 20, the molten uranium alloy is degassed. Further, since the uranium alloy is superheated in the melting and discharging unit 20 at a temperature higher than the melting temperature of the uranium alloy, the uranium alloy is completely melted.

The foil-forming unit 30 includes a turn dish 31, a nozzle 32, and a slot 33. The turn dish 31 is located below the outlet 23 of the furnace 21. The nozzle 32 is installed in the bottom of the turn dish 31, and the slot 33 is formed through the end of the nozzle 32. The turn dish 31 serves to contain the molten uranium alloy discharged from the melting and discharging unit 20 via the outlet 23 and then to supply the molten uranium alloy to the nozzle 32 in a uniform rate. The molten uranium alloy is gravitationally dropped from the turn dish 31 via the slot 33 of the nozzle 32, thereby being formed into a foil.

Since the molten uranium alloy is dropped from the turn dish 31 via the slot 33 of the nozzle 32, the foil is easily formed without any application of external force and simultaneously the dropping speed of the foil is uniformly maintained.

The contact cooling unit 40 includes a pair of cooling rolls 41 rotated in opposite directions. The cooling rolls 41 are located below the slot 33 within the chamber 11. The molten uranium alloy is formed into the foil via the slot 33, gravitationally dropped, and fed into a gap between the cooling rolls 41. Then, both sides of the foil respectively contact the cooling rolls 41, thus being rapidly cooled.

Preferably, the dropping speed of the foil and the rotational speed of the cooling rolls 41 are equal so that the dropping foil contacts the cooling rolls 41 without any application of external force.

The gas-cooling unit 60 includes a gas jetting nozzle 61, a gas supply pipe 62, and a gas supply valve 63. The gas jetting nozzle 61 is provided below the cooling rolls 41, and connected to the gas supply pipe 62 for supplying an inert gas to the gas jetting nozzle 61. The gas supply valve 63 is installed in the gas supply pipe 62 for controlling the supply of the inert gas. The gas-cooling unit 60 serves to cool again the foil cooled by the cooling rolls 41, by jetting the inert gas thereon, thus completely cooling the produced foil.

Accordingly, with the above apparatus for producing the uranium foil of the present invention, the uranium alloy is degassed, melted in the chamber 11, and formed into the foil via the slot 33, and the foil is gravitationally dropped and contacts the cooling rolls 41 so that the foil is rapidly cooled down. Thereby, the apparatus of the first embodiment of the present invention rapidly produces the uranium foil having fine crystalline granules without any separate rolling or heat treatment process.

FIGS. 3*a* to 3*e* are partially broken-away longitudinal-sectional views of the apparatus, illustrating its operation, in accordance with the first embodiment of the present invention.

Figure 3A:
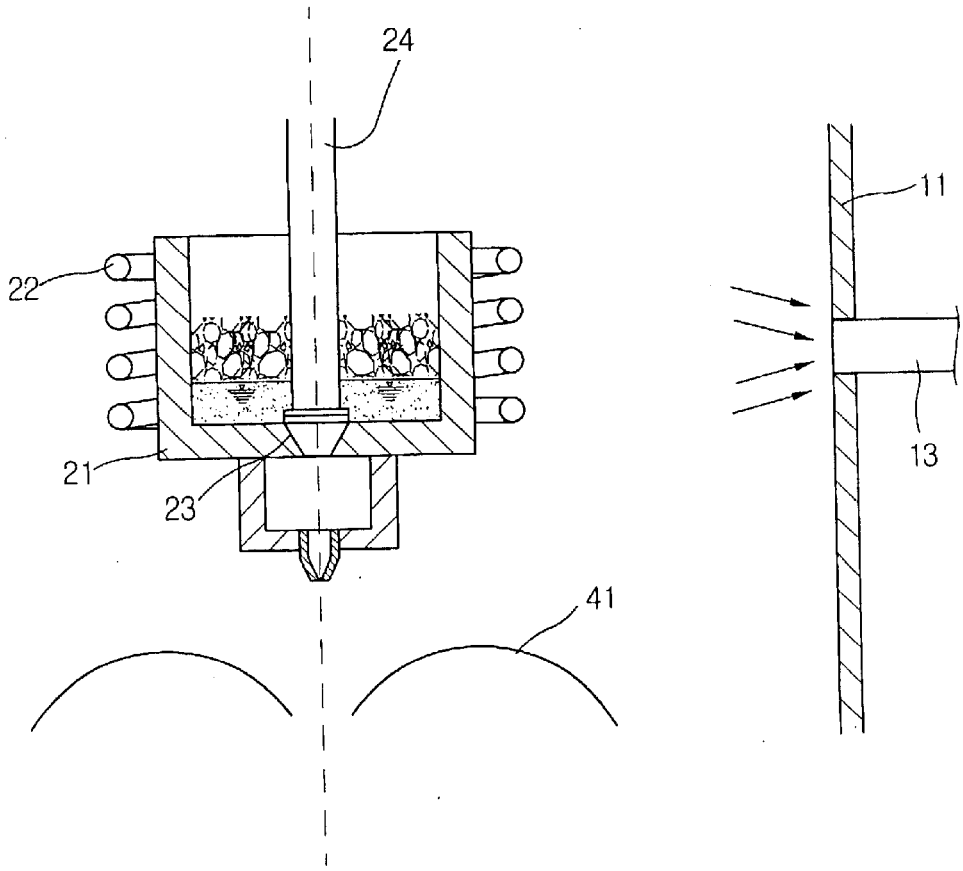
FIGS. 3*a* to 3*e* are partially broken-away longitudinal-sectional views of the apparatus, illustrating its operation, in accordance with the first embodiment of the present invention, and more specifically.
Figure 3B:
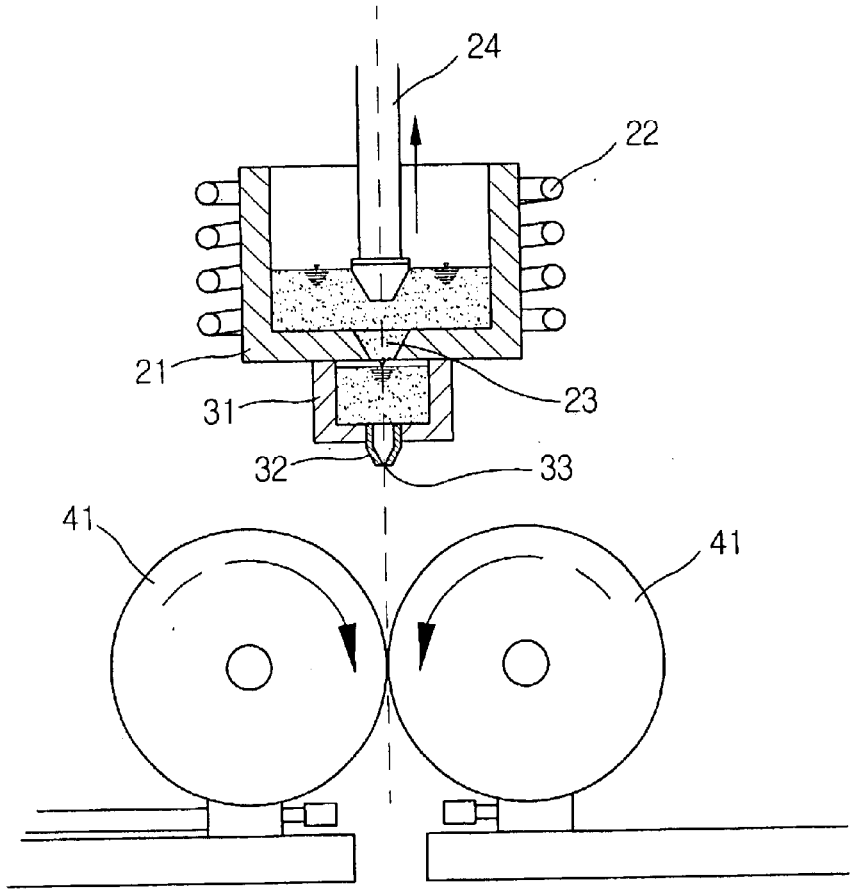
Figure 3C:
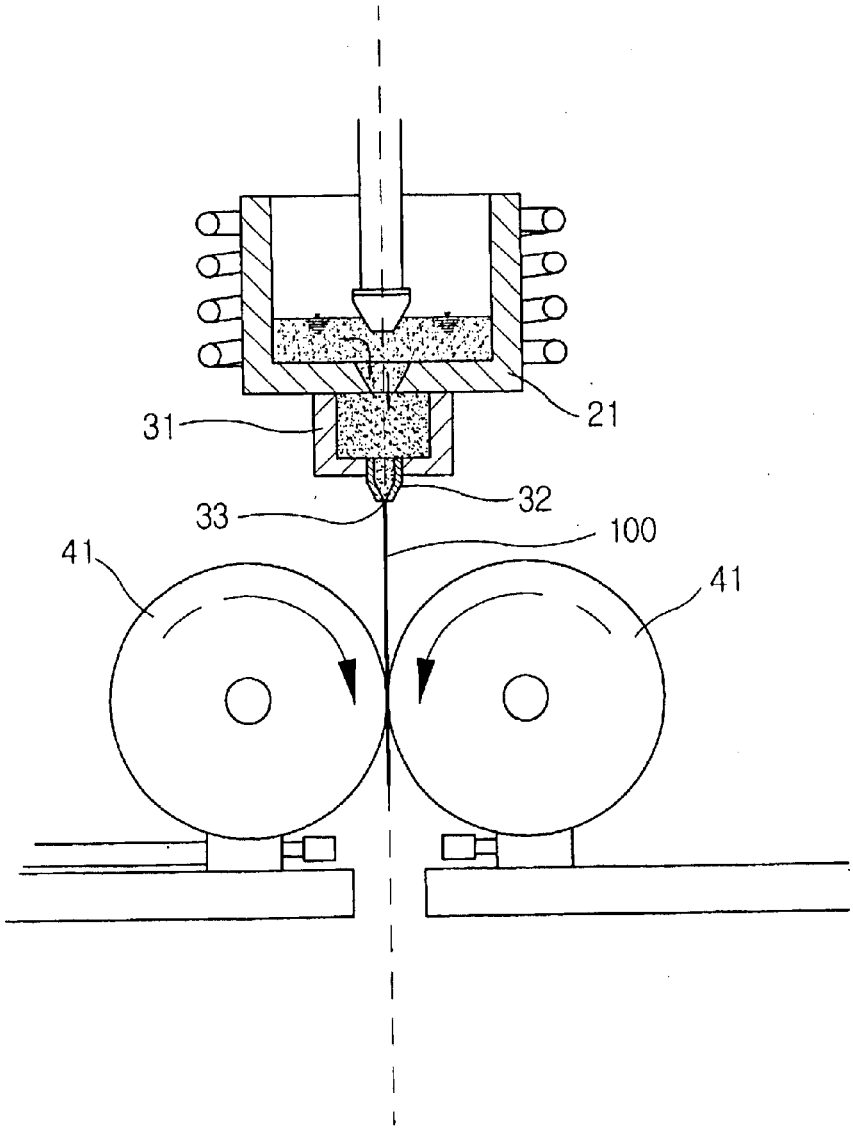
Figure 3D:
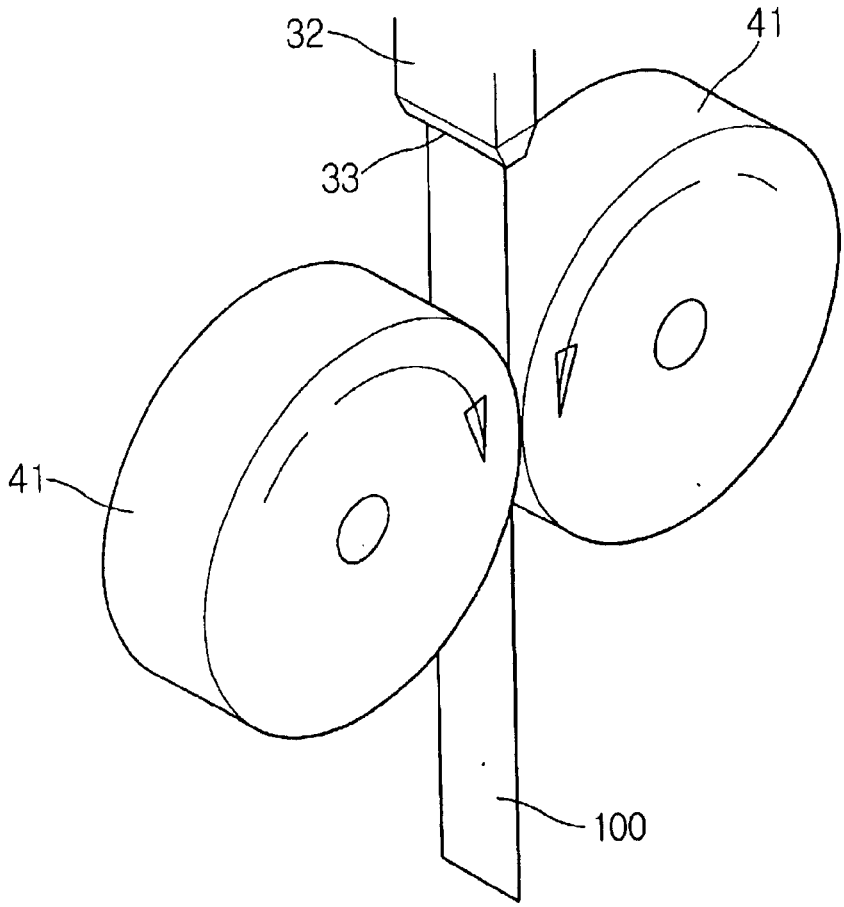
Figure 3E:
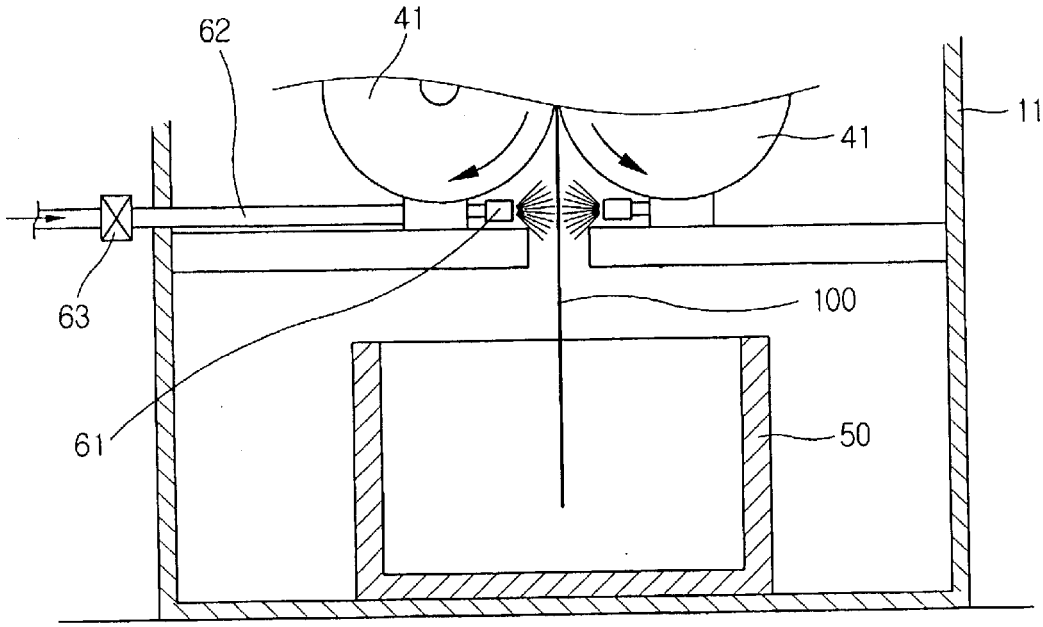

More specifically, FIG. 3*a* is an enlarged longitudinal-sectional view of the apparatus, illustrating the vacuum melting of the alloy element containing uranium;

FIG. 3*b* is an enlarged longitudinal-sectional view of the apparatus, illustrating the discharging of the molten uranium alloy;

FIG. 3*c* is an enlarged longitudinal-sectional view of the apparatus, illustrating the forming of the foil;

FIG. 3*d* is an enlarged perspective view of the apparatus, illustrating the forming of the foil; and FIG. 3*e* is an enlarged longitudinal-sectional view of the apparatus, illustrating the gas-cooling of the foil.

With reference to FIGS. 3*a* to 3*e*, a process for producing a uranium foil using the aforementioned apparatus is described, as follows.

As shown in FIG. 3*a*, the furnace 21 installed within the chamber 11 is charged with the uranium alloy and hermetically sealed. Then, air within the chamber 11 is discharged to the outside via the exhaust pipe 13 so that the chamber 11 has a proper degree of vacuum.

Under the condition that the chamber 11 has the proper degree of vacuum, the furnace 21 is heated by the high frequency induction coil 22 so that the uranium alloy within the furnace 21 is melted to be formed as molten uranium alloy.

After the uranium alloy is degassed and completely melted under the vacuum condition, the stopper 24 is elevated as shown in FIG. 3*b* so that the outlet 23 formed through the bottom of the furnace 21 is opened. Then, the turn dish 31 is filled with the molten uranium alloy discharged from the furnace 21 via the outlet 23.

Here, the cooling rolls 41 located below the furnace 21 are operated in advance at a designated rotational speed so that the foil dropped at a designated speed contacts the cooling rolls 41.

Next, as shown in FIG. 3*c*, when the turn dish 31 is completely filled with the molten uranium alloy discharged from the furnace 21 via the outlet 23, the molten uranium alloy is gravitationally dropped from the turn dish 31 via the slot 33 of the nozzle 32 installed in the bottom of the turn dish 31, thereby being formed into a foil.

Such a gravitational dropping of the foil is described in more detail in FIG. 3*d*. As shown in FIG. 3*d*, the foil 100 is formed and gravitationally dropped through the slot 33 without any application of external force, and then passes through the gap between a pair of the cooling rolls 41 so that the both sides of the foil 100 respectively contact the cooling rolls 41, thus being rapidly cooled down.

Here, the cooling rolls 41 only contact the both sides of the foil 100 without imposing any drawing force to the foil 100, thereby not imparting residual stress to crystalline granules of the foil 100 during the cooling of the foil 100.

As shown in FIG. 3*e*, after the foil 100 without application of external force is rapidly cooled by the cooling rolls 41, the foil 100 is cooled one more time by an inert gas jetted from the gas jetting nozzle 61 located below the cooling rolls 41. The completely cooled foil 100 is contained and collected by the collection tray 50.

Accordingly, the above apparatus in accordance with the first embodiment of the present invention forms the foil by gravitational dropping without application of external force, cools the foil by direct contact with cooling means, thereby easily producing the uranium foil having fine crystalline granules without deforming the crystalline granules and imparting residual stress on the crystalline granules.

Figure 4:
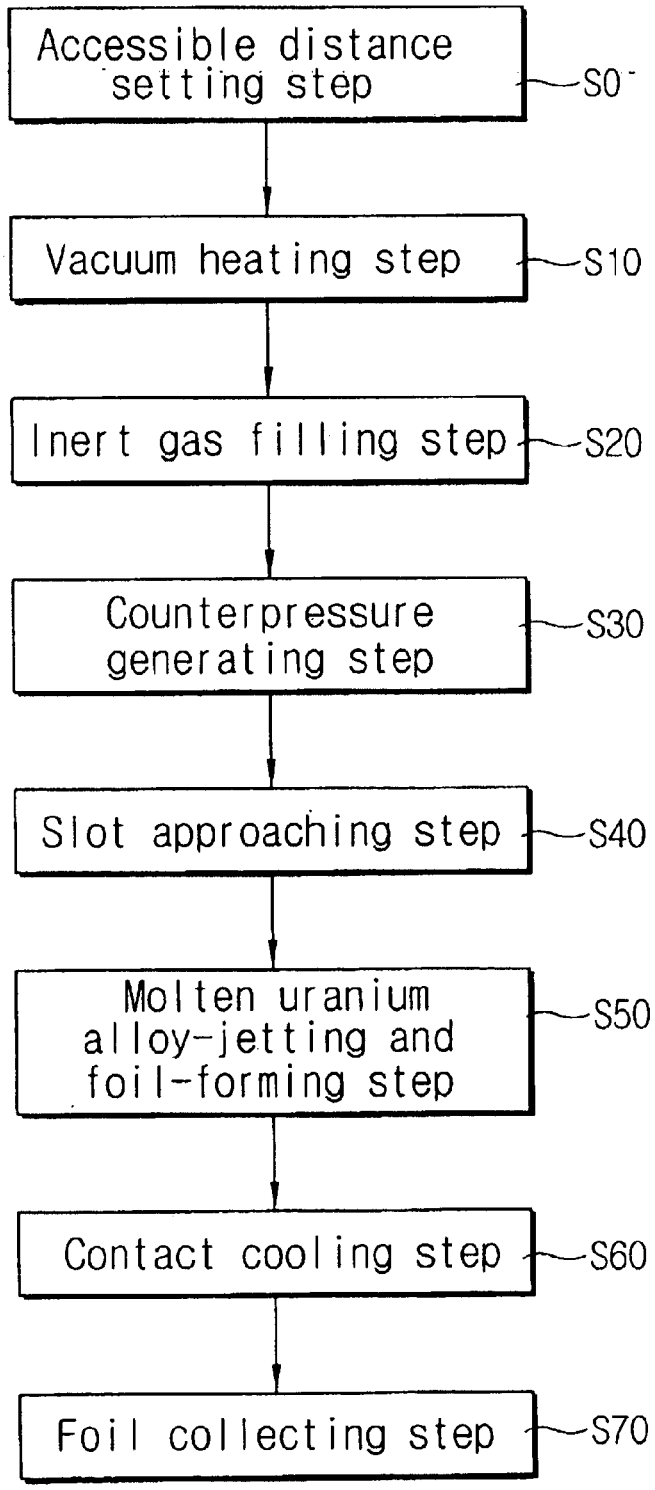
FIG. 4 is a block diagram illustrating a method for producing a uranium foil in accordance with a second embodiment of the present invention.

FIG. 4 is a block diagram illustrating a method for producing a uranium foil in accordance with a second embodiment of the present invention. With reference to FIG. 4, the method for producing the uranium is described, as follows.

The above method for producing the uranium foil comprises, in sequence, accessible distance setting step (S0), vacuum heating step (S10), inert gas filling step (S20), counterpressure generating step (S30), slot approaching step (S40), molten uranium alloy-jetting and foil-forming step (S50), contact cooling step (S60), and foil collecting step (S70).

The above method for producing the uranium foil may be applied to uranium alloy as well as uranium. Particularly, the uranium alloy contains uranium and three elements (hereinafter, referred to as U-Q-X-Y). The Q, X, and Y elements are different ones selected from the group consisting of Al, Fe, Ni, S1, Cr, Zr, Mo, and Nb. The Q element is present in an amount of 0 to 10 wt. %, the X element is present in an amount of 0 to 1 wt. %, and the Y element is present in an amount of 0 to 1 wt. %.

More specifically, at accessible distance setting step (S0), a furnace moves downward so that a slot of the furnace contacts the outer circumference of a cooling roll. Such a position of the slot is designated as the zero point. Then, the furnace moves upward so that the slot of the furnace is located close to the outer circumference of the cooling roll. Such a position of the slot is designated as a proximal position. The designated proximal position of the slot is precisely determined relative to the cooling roll.

At vacuum heating step (S10), the furnace provided with a nozzle in its bottom is charged with uranium alloy, and a chamber for accommodating the furnace is hermetically sealed so that a vacuum is formed in the chamber. When the chamber reaches a proper degree of vacuum, the furnace is heated by a high frequency induction coil wound around the outer surface of the furnace.

Here, the furnace is heated by a high frequency induction coil wound so that the uranium alloy is degassed and melted under the vacuum condition.

Preferably, at vacuum heating step (S10), the degree of vacuum within the chamber is in the range of $10^{-3}$~$10^{-5}$ torr. In case that the degree of vacuum within the chamber is not less than $10^{-3}$ torr, it is difficult to degas the uranium alloy. On the other hand, in case that the degree of vacuum within the chamber is not more than $10^{-5}$ torr, the excessive degree of vacuum is formed within the chamber and it is difficult to fill the chamber with an inert gas and to generate a counterpressure in the chamber.

At inert gas filling step (S20), before the uranium alloy is melted under the vacuum condition by heating the furnace at vacuum heating step (S10), the vacuum in the chamber is broken, and the chamber and the furnace are filled with an inert gas until the chamber and the furnace reach designated pressures.

Here, the vacuum in the chamber must be broken before the uranium alloy is melted, in order to generate the counterpressure before molten uranium alloy is discharged from the furnace via the nozzle into the chamber.

At counterpressure generating step (S30), after the chamber and the furnace is completely filled with the inert gas at inert gas filling step (S20), the furnace is sealed. Then, the inert gas is further injected into the chamber so that the chamber has a higher pressure than the furnace, thereby generating a counterpressure in the furnace.

Here, counterpressure generating step (S30) serves to prevent the uranium alloy from being leaked via the nozzle in the bottom of the furnace during the melting by means of the difference of pressure between the furnace and the chamber.

Preferably, the difference of pressure between the furnace and the chamber is in the range of 30 torr to 300 torr. In case that the difference of pressure is not more than 30 torr, the molten uranium alloy is leaked via the nozzle due to the weight of the alloy. In case that the difference of pressure is not less than 300 torr, the furnace is damaged or the molten uranium alloy overflows the furnace.

At slot approaching step (S40), the uranium alloy is continuously heated during the maintaining of the counterpressure at counterpressure generating step (S30) so as to form the molten uranium alloy with a designated temperature. Then, the furnace moves downward so that the slot approaches the outer circumference of the cooling roll uniformly rotated at a high speed.

Here, preferably, the temperature of the molten uranium alloy at slot approaching step (S40) is in the range of 1,150 to 1,400° C. In case that the temperature of the molten uranium alloy is not more than 1,150° C., the uranium alloy cannot be completely melted. In case that the temperature of the molten uranium alloy is not less than 1,400° C., the molten uranium alloy is excessively overheated.

Further, preferably, the distance between the slot and the cooling roll at slot approaching step (S40) is in the range of 0.3 mm to 1.0 mm. In case that the distance between the slot and the cooling roll is not more than 0.3 mm, the molten uranium alloy discharged from the furnace is solidified around the slot, thereby preventing the efficient production of the foil. On the other hand, in case that the distance between the slot and the cooling roll is not less than 1.0 mm, the molten uranium alloy is irregularly discharged from the furnace via the slot to the cooling roll, thereby causing the foil solidified on the outer circumference of the cooling roll to have irregularities to be not smooth.

At molten uranium alloy-jetting and foil-forming step (S50), after the slot approaches the cooling roll, the inert gas is further injected into the furnace, thereby breaking the counterpressure in the furnace. Then, the molten uranium alloy is discharged as a foil form to the outer circumference of the cooling roll at a uniform pressure via the slot.

Here, preferably, the width of the slot is in the range of 0.3 mm to 1.0 mm. In case that the width of the slot is not more than 0.3 mm, the foil is cut, and thus the foil cannot be produced continuously. On the other hand, in case that the width of the slot is not less than 1.0 mm, the foil has irregularities on its upper surface to be not smooth.

Further, preferably, the blast pressure of the molten uranium alloy via the slot of the nozzle at molten uranium alloy-jetting and foil-forming step (S50) is in the range of 0.2 kg/cm$^2$ to 2.5 kg/cm$^2$. In case that the blast pressure of the molten uranium alloy is not more than 0.2 kg/cm$^2$, it is difficult to properly discharge the molten uranium alloy via the slot. On the other hand, in case that the blast pressure of the molten uranium alloy is not less than 2.5 kg/cm$^2$, since the molten uranium alloy is excessively discharged via the slot, it is difficult to produce the foil with a uniform thickness.

At contact cooling step (S60), after the foil formed from the molten uranium alloy discharged via the slot contacts the outer circumference of the cooling roll, the cooling roll is rotated along with the foil thereon, thereby rapidly cooling the foil.

Here, preferably, the rotational speed of the cooling roll is in the range of 200 rpm to 1,200 rpm. In case that the rotational speed of the cooling roll is not more than 200 rpm, since the foil-shaped molten uranium alloy is stacked on the outer circumference of the cooling roll, the foil cannot have the uniform thickness. On the other hand, in case that the rotational speed of the cooling roll is not less than 1,200 rpm, the foil cannot have the uniform thickness and be continuously formed.

At foil collecting step (S70), the cooled and solidified foil is contained and collected by a collection tray located close to the cooling roll.

In accordance with the above-described method for producing the uranium foil, the uranium alloy is degassed and melted under the vacuum condition, completely melted under the condition that the leakage of the alloy is prevented by the counterpressure generated in the furnace and the chamber by means of the inert gas, formed into the foil by being discharged via the slot, and contacting the cooling roll so as to be rapidly cooled when the slot approaches the cooling roll. Accordingly, it is possible to easily produce the uranium foil having fine crystalline granules.

Figure 5:
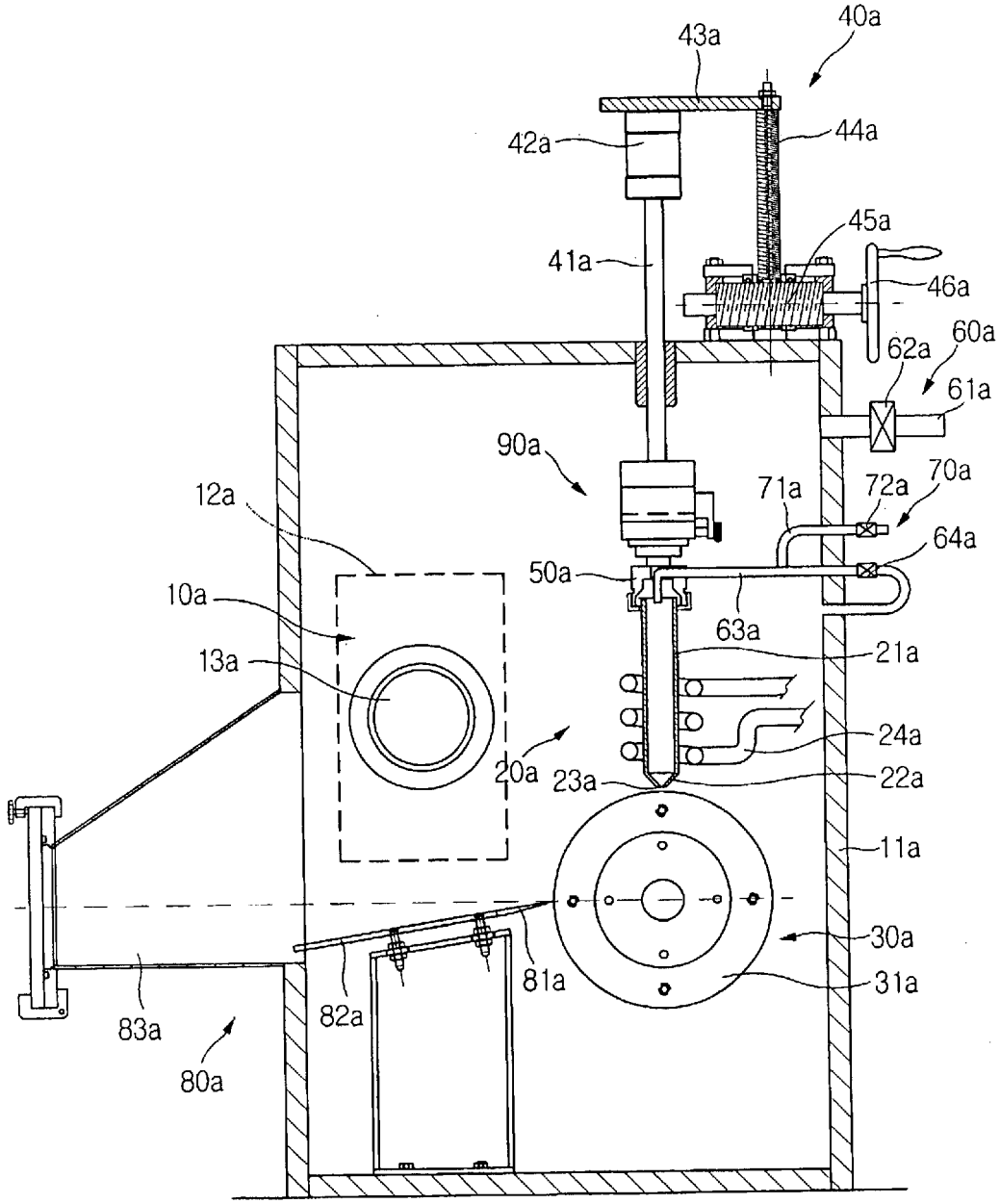
FIG. 5 is a schematic longitudinal-sectional view of an apparatus for producing a uranium foil in accordance with the second embodiment of the present invention.

FIG. 5 is a schematic longitudinal-sectional view of an apparatus for producing a uranium foil in accordance with the second embodiment the present invention. With reference to FIG. 5, the apparatus for producing the uranium foil is described, as follows.

The apparatus for producing the uranium foil comprises a vacuum unit 10*a*, a melting and discharging unit 20*a*, a contact cooling unit 30*a*, a moving unit 40*a*, a sealing unit 50*a*, a counterpressure generating unit 60*a*, a jetting unit 70*a*, a collecting unit 80*a*, and jetting angle control unit 90*a*. The vacuum unit 10*a* forms a vacuum in a chamber 11*a*. The melting and discharging unit 20*a* is located within the chamber 11*a*, and serves to melt uranium or uranium alloy and cast the molten uranium or alloy into a foil. The contact cooling unit 30*a* contacts the foil cast by the melting and discharging unit 20*a*, thereby rapidly cooling the foil. The moving unit 40*a* moves a furnace 21*a* downward so that a slot 23*a* of the furnace 21*a* closely approaches the outer circumferences of cooling roll 31*a*. The counterpressure generating unit 60*a* serves to generate a counterpressure in the chamber 11*a* and the furnace 21*a*. The jetting unit 70*a* jets the molten uranium alloy from the furnace 21*a* through the slot 23*a*. The collecting unit 80*a* serves to collect the produced foil. The jetting angle control unit 90*a* horizontally moves the furnace 21*a*, thereby controlling a jetting angle of the molten uranium alloy toward the cooling roll 31*a*.

More specifically, the vacuum unit 10*a* includes the hermetically sealed chamber 11*a,* and an exhaust pump 12*a* located at the outside of the chamber 11*a* and connected to the chamber 11*a* via an exhaust pipe 13*a*. Air within the chamber 11*a* is exhausted to the outside via the exhaust pipe 13*a* by the operation of the exhaust pump 12*a*. Thus, the inside of the chamber 11*a* has a proper degree of vacuum.

The melting and discharging unit 20*a* includes the furnace 21*a* made of transparent quartz, a nozzle 22*a* installed through the bottom of the furnace 21*a* and provided with a slot 23*a*, and a high frequency induction coil 24*a* wound around the outer circumference of the furnace 21*a*. The furnace 21*a* is charged with uranium or uranium alloy, and then heated by the high frequency induction coil 24*a* so that the uranium alloy is melted to form molten uranium alloy. The molten uranium alloy is jetted via the slot 23*a*, thereby being cast into a foil.

The contact cooling unit 30*a* includes a cooling roll 31*a* positioned below the slot 23*a* within the chamber 11*a* and rotated at a designated speed. The foil discharged from the furnace 21*a* through the slot 23*a* contacts the cooling roll 31*a*, thereby being rapidly cooled.

The moving unit 40*a* includes a sliding rod 41*a* connected to the top of the furnace 21*a*, a hydraulic cylinder 42*a* fixed to the top of the sliding rod 41*a* by a fixing plate 43*a* so that the sliding rod 41*a* is moved downward by the hydraulic cylinder 42*a*, a spiral rotary shaft 44*a* rotatably connected to the fixing plate 43*a*, a worm gear 45*a* engaged with the spiral rotary shaft 44*a*, and a knob 46*a* for rotating the worm gear 45*a*.

Here, The sliding rod 41*a* of the moving unit 40*a* is moved downward by the operation of the hydraulic cylinder 42*a* so that the slot 23*a* of the furnace 21*a* closely approaches the outer circumference of the cooling roll 31*a*.

First, the sliding rod 41*a* is lowered by the operation of the worm gear-45 due to the turning of the knob 46*a* so that the distance between the slot 23*a* and the cooling roll 31*a* can be predetermined by a user. Then, when the slot 23*a* becomes close to the outer circumference of the cooling roll 31*a*, the position of the slot 23*a* is adjusted by the operation of the hydraulic cylinder 42*a* so that the distance between the slot 23*a* and the cooling roll 31*a* reaches the predetermined value.

The sealing unit 50*a* is located at the top of the furnace 21*a*, and serves to hermetically seal and fix the furnace 21*a*.

The counterpressure generating unit 60*a* includes a gas feed pipe 61*a* provided with a gas supply valve 62*a*, and a furnace flow pipe 63*a* provided with a switching valve 64*a* for connecting the furnace 21*a* and the chamber 11*a*.

An inert gas is injected into the chamber 11*a* and the furnace 21*a* via the gas feed pipe 61*a* so that the chamber 11*a* and the furnace 21*a* have the same pressure. Subsequently, the switching valve 64*a* of the furnace flow pipe 63*a* is locked, and the inert gas is further injected only into the chamber 11*a* via the gas feed pipe 61*a* so that there occurs the difference of pressure between the chamber 11*a* and the furnace 21*a*. Thereby, the molten uranium alloy obtained by the heating of the furnace 21*a* by the high frequency induction coil 24*a* is not discharged from the furnace 21*a* to the chamber 11*a* via the slot 23*a*.

The jetting unit 70*a* includes a gas injection pipe 71*a* branched from the furnace flow pipe 63*a*, and a gas injection valve 72*a* installed in the gas injection pipe 71*a*. When the molten uranium alloy is obtained within the furnace 21*a*, the gas injection valve 72*a* is unlocked so that the inert gas is injected into the furnace 21*a* via the gas injection pipe 71*a* and the furnace flow pipe 63*a*. Thus, the molten uranium alloy is jetted from the furnace 21*a* into the chamber 11*a* through the slot 23*a*.

The collecting unit 80*a* includes a blade 81*a* positioned to be in contact with the cooling roll 31*a* so as to remove the rapidly cooled foil from the outer circumference of the cooling roll 31*a*, a guide plate 82*a* for supporting the blade 81*a* and guiding the foil, and a collection tray 83*a* located close to the guide plate 82*a* for containing the collected foil.

Here, the blade 81*a* is made of Teflon, thus easily removing the cooled foil from the outer circumference of the cooling roll 31*a* without causing damage to the surface of the cooling roll 31*a*.

The jetting angle control unit 90*a* is located between the sealing unit 50*a* and the sliding rod 41*a*. The jetting angle control unit 90*a* horizontally moves the furnace 21*a*, thereby adjusting the angle of jetting the molten uranium alloy from the furnace 21*a* toward the outer circumference of the cooling roll 31*a* via the slot 23*a*.

Preferably, the furnace flow pipe 63*a* connected to the furnace 21*a* is made of flexible material, thereby allowing the furnace 21*a* to be freely moved by the jetting angle control unit 90*a*.

Hereinafter, with reference to FIG. 6, the apparatus for producing the uranium foil in accordance with the second embodiment of the present invention as shown in FIG. 5 is described in detail.

Figure 6:
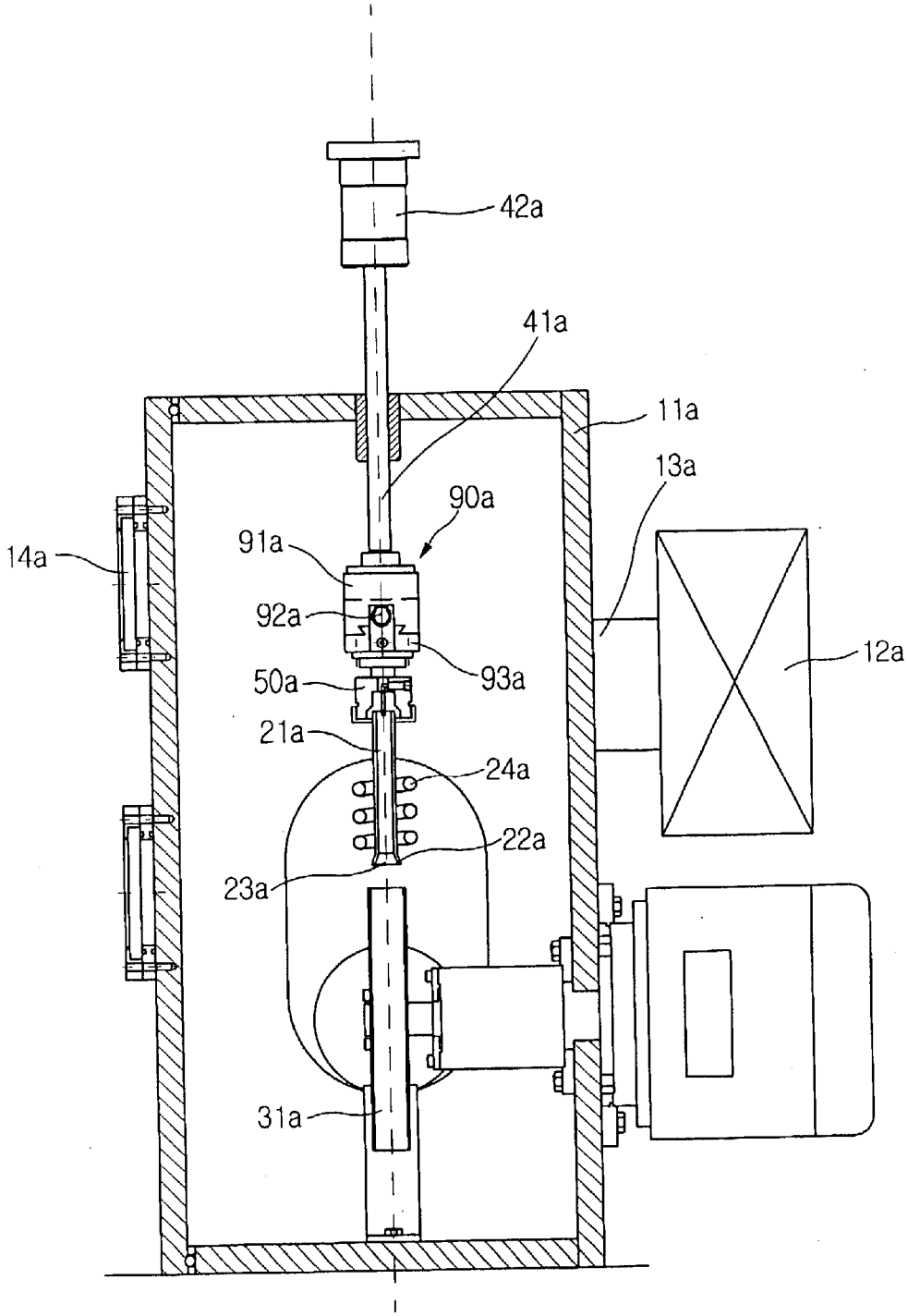
FIG. 6 is a schematic side view of the apparatus of FIG. 5.

As shown in FIG. 6, the sliding rod 41*a* being movable upward and downward by the hydraulic cylinder 42*a* is inserted into the chamber 11*a*. The jetting angle control unit 90*a* is located below the sliding rod 41*a*. The sealing unit 50*a* is located below the jetting angle control unit 90*a*. The furnace 21*a*, which is opened at its top, is positioned under the sealing unit 50*a*. The nozzle 22*a* and the slot 23*a* are installed in the bottom of the furnace 21*a*. The cooling roll operated by a motor is located below the slot 23*a*.

Windows 14*a* are formed through the front surface of the chamber 11*a,* and the exhaust pump 12*a* connected to the exhaust pipe 13*a* is provided at the rear surface of the chamber 11*a*.

The jetting angle control unit 90*a* includes a guide rail 91*a* and a guide block 93*a*. The guide rail 91*a* provided with a feed screw 92*a* is positioned between the sealing unit 50*a* and the sliding rod 41*a* so as to horizontally move the sealing unit 50*a*. The guide block 93*a* is located below the guide rail 91*a* and moved by the rotation of the feed screw 92*a*.

When the user rotates the feed screw 92*a*, the guide block 93*a* moves back and forth along the guide rail 91*a*, thus allowing the slot 23*a* to horizontally move along the outer circumference of the cooling roll 31*a*. Thereby, the molten uranium alloy is jetted from the furnace 21*a* via the slot 23*a* toward the cooling roll 31*a* at a proper angle.

The furnace 21, the nozzle 22*a*, and the slot 23*a* are integrally formed, and made of transparent quartz so that the user observes the melting of the uranium alloy in the furnace 21*a* through the windows 14*a*. Accordingly, just before the molten uranium alloy is discharged from the furnace 21*a* via the slot 23*a*, the counterpressure can be properly generated in the furnace 21*a* and the chamber 11*a*.

FIGS. 7*a* to 7*f* are partially broken-away longitudinal-sectional views of the apparatus, illustrating its operation, in accordance with the second embodiment of the present invention.

Figure 7A:
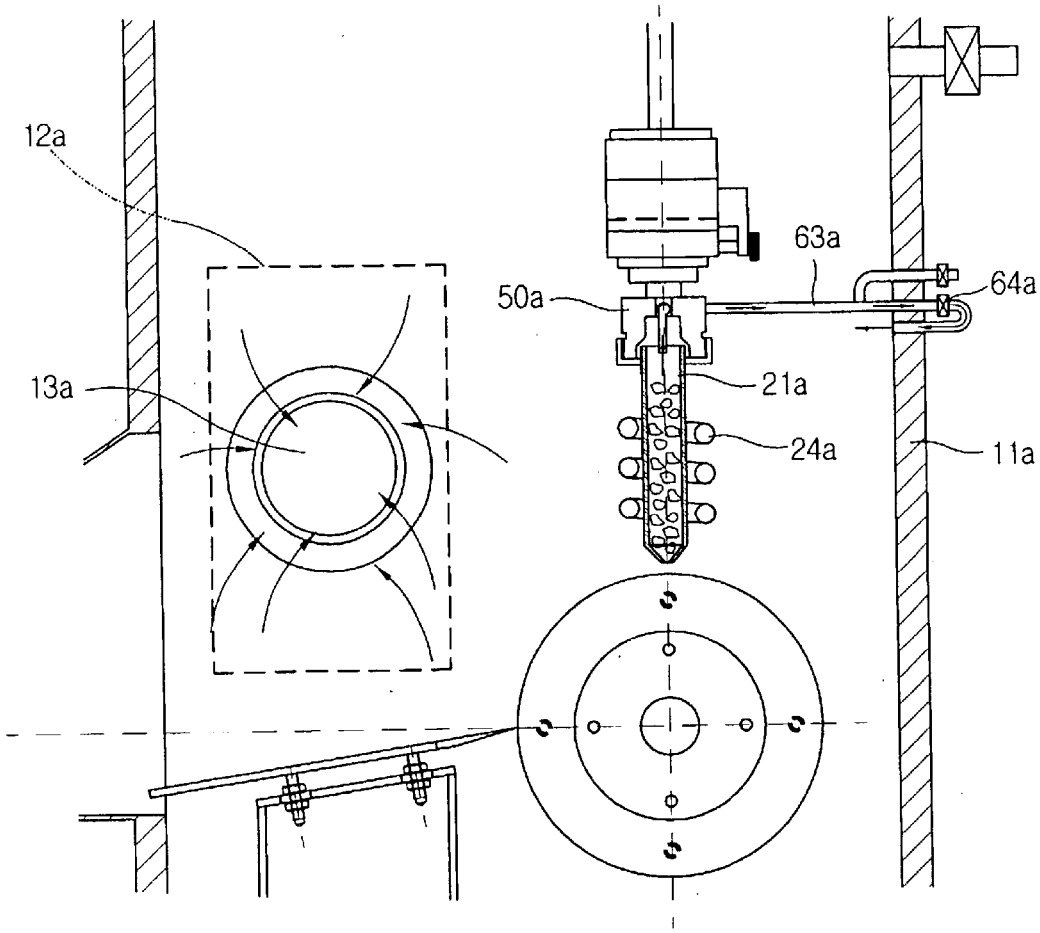
FIGS. 7*a* to 7*f* are partially broken-away longitudinal-sectional views of the apparatus, illustrating its operation, in accordance with the second embodiment of the present invention, and more specifically.
Figure 7B:
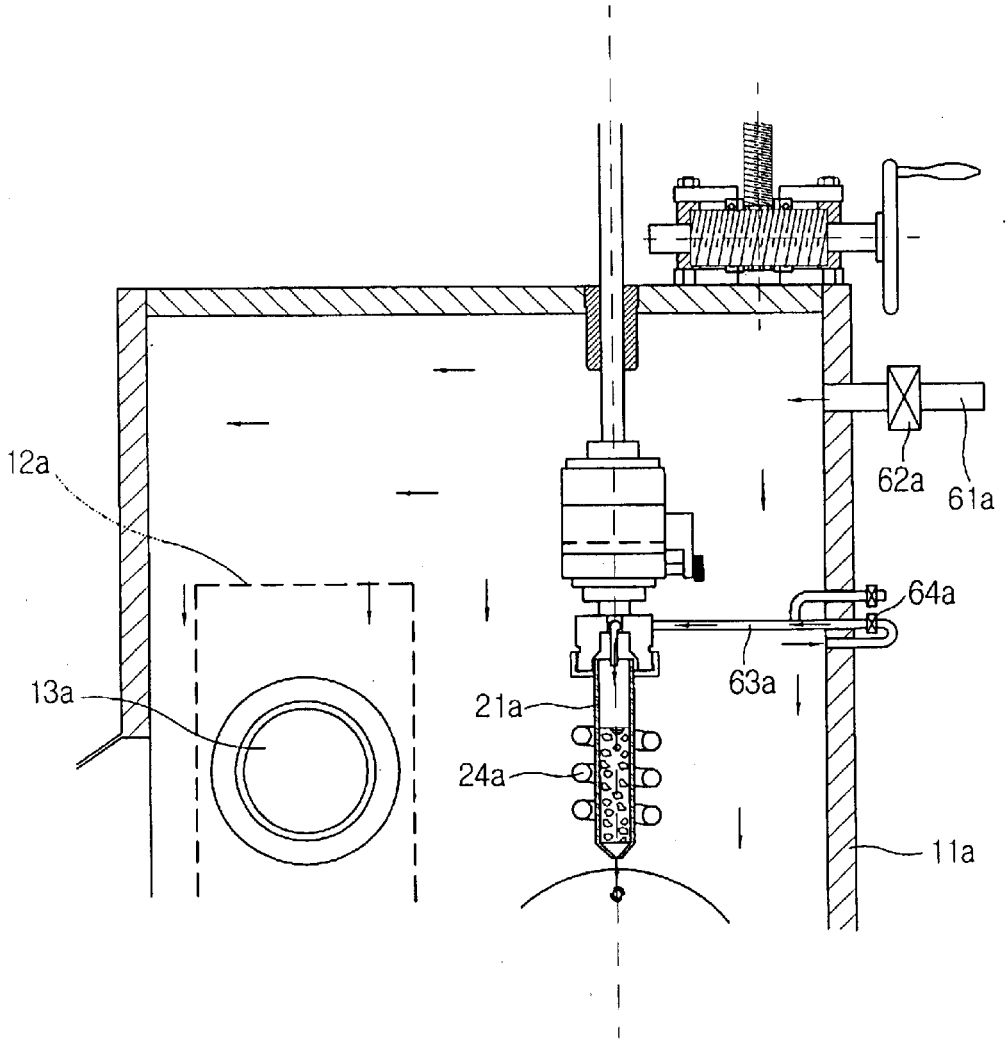
Figure 7C:
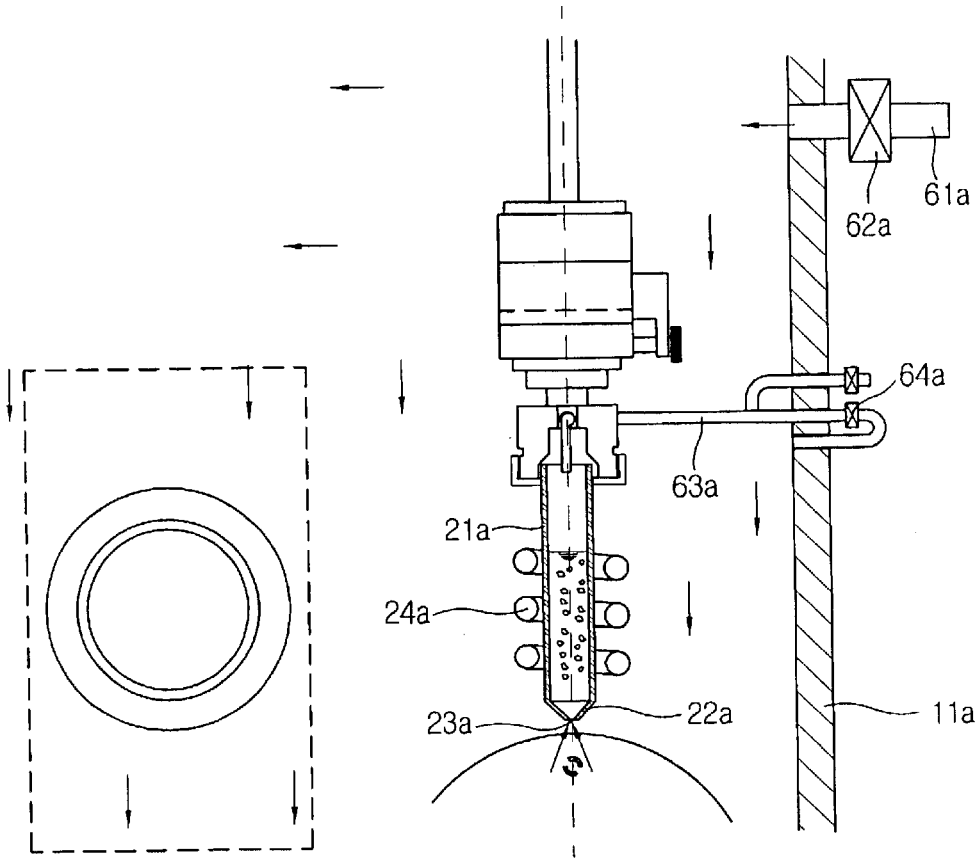
Figure 7D:
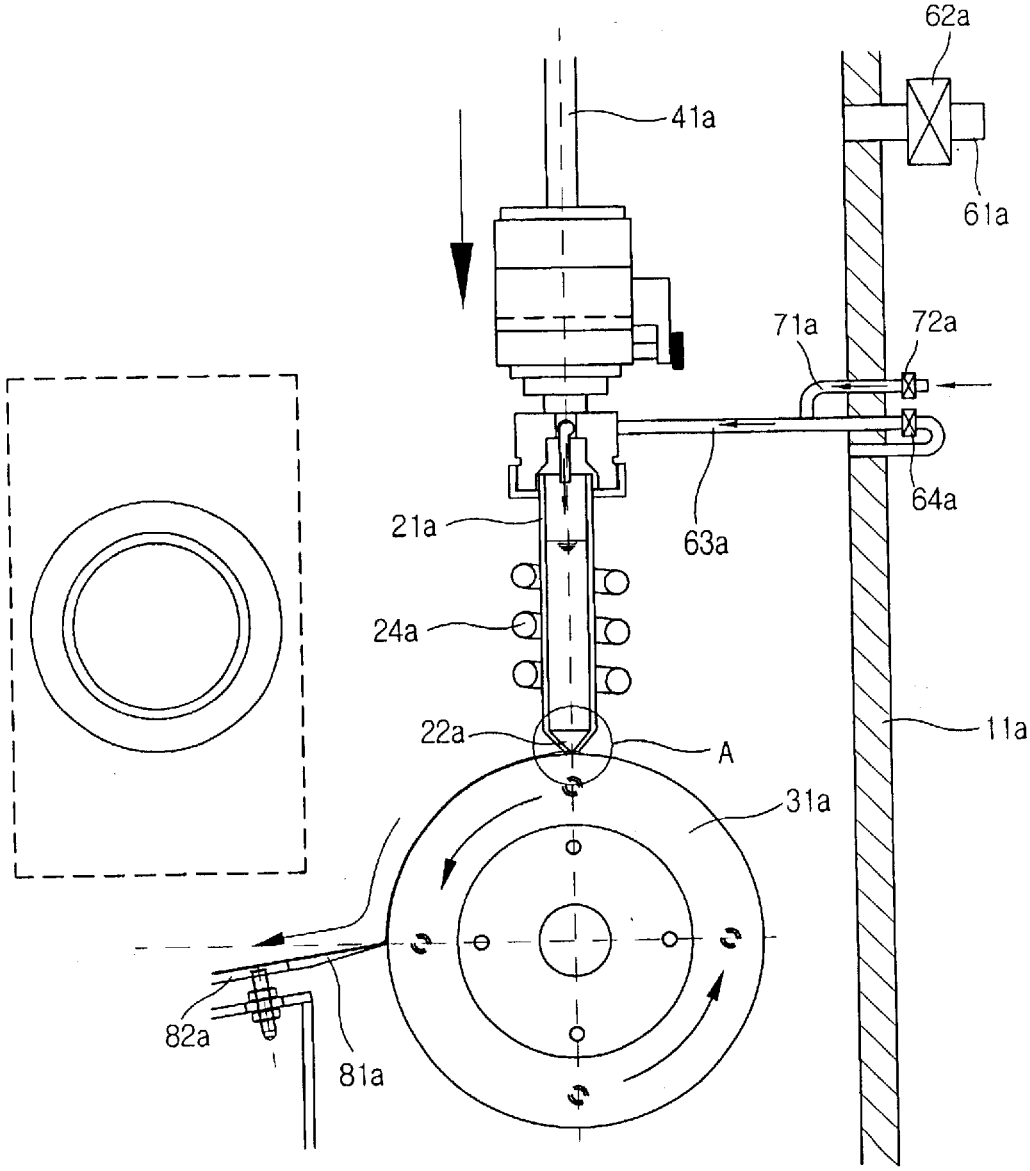
Figure 7E:
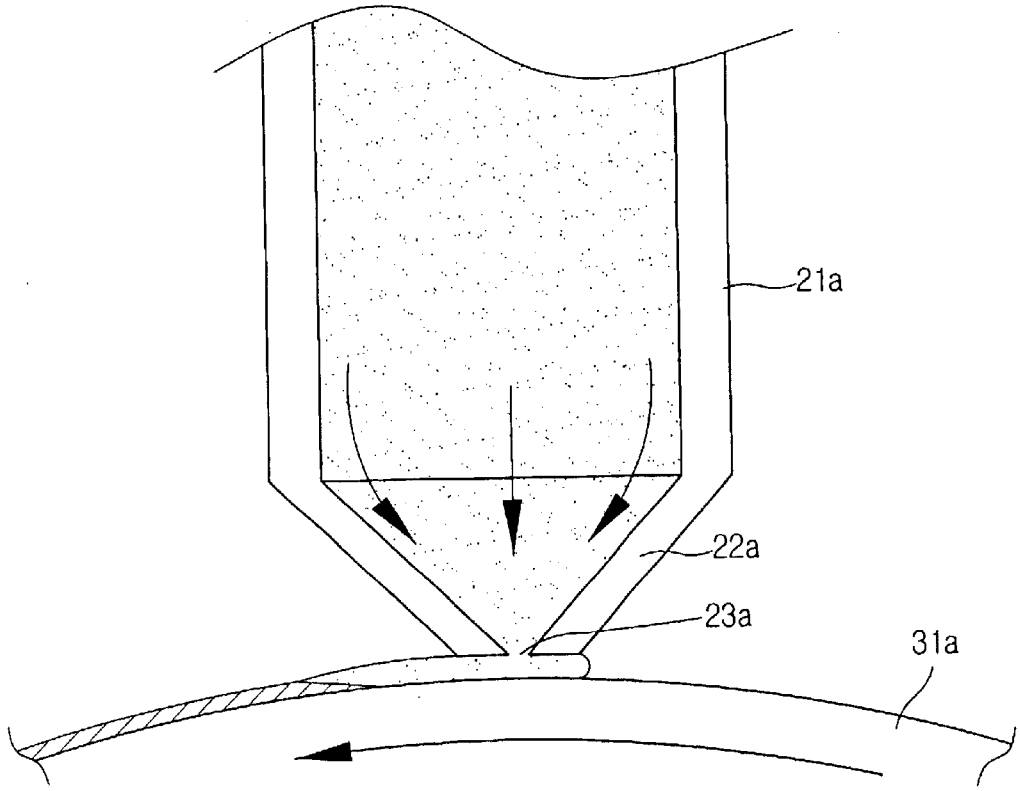

More specifically, FIG. 7*a* is an enlarged longitudinal-sectional view of the apparatus, illustrating the melting of the uranium alloy under the vacuum condition;

FIG. 7*b* is an enlarged longitudinal-sectional view of the apparatus, illustrating the filling of the chamber with inert gas;

FIG. 7*c* is an enlarged longitudinal-sectional view of the apparatus, illustrating the forming of counterpressure;

FIG. 7*d* is an enlarged longitudinal-sectional view of the apparatus, illustrating the discharging of the molten uranium alloy when the slot approaches the cooling roll;

FIG. 7*e* is an enlarged view of a part "A" of FIG. 7*d*; and

Figure 7F:
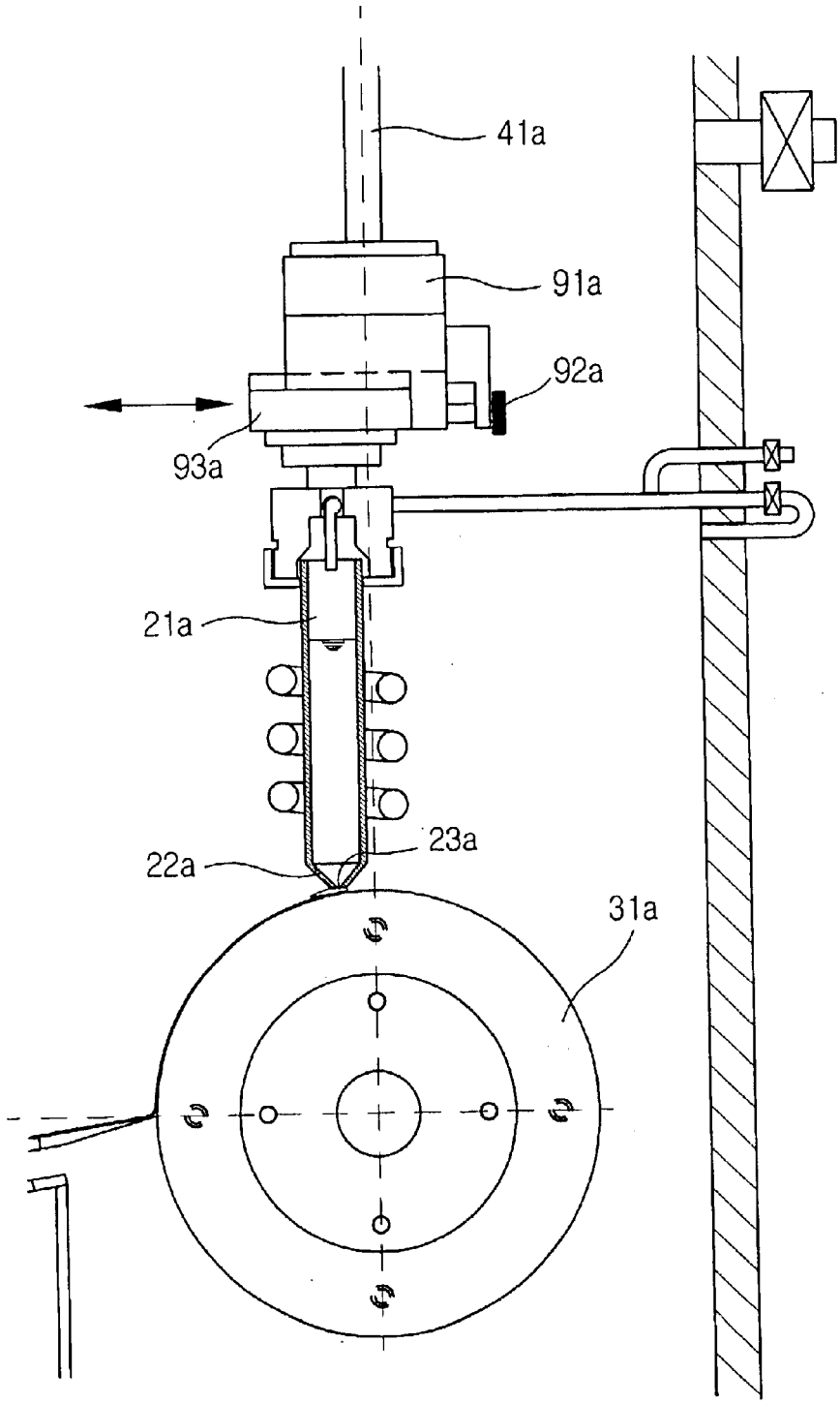

FIG. 7*f* is an enlarged longitudinal-sectional view of the apparatus, illustrating the adjusting of the jetting angle of the molten uranium alloy.

With reference to FIGS. 7*a* to 7*f*, the operation of the apparatus for producing the uranium foil is described, as follows.

As shown in FIG. 7*a*, the furnace 21*a* located within the chamber 11*a* is charged with the uranium alloy, and the chamber 11*a* is hermetically sealed. Then, air within the chamber 11*a* is discharged to the outside via the exhaust pipe 13*a* by the operation of the exhaust pump 12*a* so that a vacuum is formed in the chamber 11*a*. The furnace 21*a* is heated by the high frequency induction coil 24*a* so that the uranium alloy within the furnace 21*a* is melted to form molten uranium alloy.

Here, the switching valve 64*a* of the furnace flow pipe 63*a* connected to the sealing unit 50*a* for connecting the furnace 21*a* and the chamber 11*a* is unlocked so that the furnace 21*a* and the chamber 11*a* have a designated degree of vacuum, thereby degassing the uranium alloy to be melted.

As shown in FIG. 7*b*, before the furnace 21*a* is heated by the high frequency induction coil 24*a* so that the uranium alloy is completely melted, the exhaust pump 12*a* is stopped, thereby breaking the vacuum in the chamber 11*a*. Then, the gas supply valve 62*a* is unlocked so that the inert gas is introduced into the chamber 11*a* via the gas feed pipe 61*a* and simultaneously into the furnace 21*a* via the furnace flow pipe 63*a*. Thereby, the chamber 11*a* and the furnace 21*a* have the same pressure.

As shown in FIG. 7*c*, the switching valve 64*a* of the furnace flow pipe 63*a* is locked so that the chamber 11*a* and the furnace 21*a* are sealed. Then, the inert gas is further introduced into the chamber 11*a* via the gas feed pipe 61*a* so that the chamber 11*a* has a higher pressure than the furnace 21*a*, thereby generating a counterpressure in the furnace 21*a* due to the difference of pressure between the chamber 11*a* and the furnace 21*a*.

Under the condition that the counterpressure generated in the furnace 21*a* is maintained, as shown in FIG. 7*d*, the furnace 21*a* is continuously heated by the high frequency induction coil 24*a* so as to form the molten uranium alloy at a designated temperature. Then, the sliding rod 41*a* is moved downward so that the slot 23*a* of the furnace 21*a* closely approaches the outer circumference of the cooling roll 31*a* uniformly rotated at a high speed.

After the slot 23*a* closely approaches the outer circumference of the cooling roll 31*a*, the gas injection valve 72*a* is unlocked so that the inert gas is injected into the furnace 21*a* via the gas injection pipe 71*a* and the furnace flow pipe 63*a*. Thereby, the molten uranium alloy is jetted from the furnace 21*a* to the outer circumference of the cooling roll 31*a* at a uniform pressure.

When the molten uranium alloy is jetted to the outer circumference of the cooling roll 31*a* from the furnace 21*a* located close to the cooling roll 31*a*, the molten uranium alloy is jetted and simultaneously cast into a foil via the slot 23*a*. The foil is positioned on the outer circumference of the cooling roll 31*a*, and rotated along with the rotation of the cooling roll 31*a*, thereby being rapidly cooled to form fine crystalline granules. The obtained uranium foil with fine crystalline granules is separated from the cooling roll 31*a* by the blade 81*a*, and guided and transferred along the guide block 82*a*.

As shown in FIG. 7*e*, the molten uranium alloy, jetted and cast into the foil via the slot 23*a* of the nozzle 22*a*, and then positioned on the outer circumference of the cooling roll 31*a*, is rotated by the rotation of the cooling roll 31*a*, thereby being rapidly cooled.

Since the molten uranium alloy is jetted to the cooling roll 31*a* via the slot 23*a* at the uniform pressure, the uranium foil with a uniform thickness is continuously produced. Further, since the foil contacts the cooling roll 31*a* and is rapidly cooled, the high-purity and high-quality uranium foil having fine crystalline granules, irregular crystal orientation, and excellent mechanical characteristics is produced.

As shown in FIG. 7*f*, when a user rotates the feed screw 92*a*, the guide block 93*a* is transferred along the guide rail 91*a*, thereby horizontally moving the furnace 21*a* above the cooling roll 23*a*. Thus, the angle of jetting the molten uranium alloy from the furnace 21*a* to the outer circumference of the cooling roll 31*a* via the slot 23*a* is properly adjusted.

Hereinafter, two examples of the method for producing the uranium foil in accordance with the second embodiment of the present invention are described in detail.

EXAMPLE 1

Uranium 500 g is introduced into the furnace with a diameter of 50 mm, made of quartz, and a vacuum is formed within the chamber by the operation of the exhaust pump.

When the degree of vacuum in the chamber reaches $10^{-5}$ torr, the furnace is heated by the high frequency induction coil. Before the uranium is melted, the vacuum in the chamber is broken and the high-purity inert gas is injected into the chamber until the pressure of the chamber and the furnace reaches 600 torr.

Here, in order to prevent the molten uranium from being leaked via the slot with a length of 45 mm and a width of 0.6 mm, the furnace is sealed and the inert gas is further injected into the chamber so that the pressure of the chamber reaches 650 torr. Thus, a counterpressure is generated in the furnace due to the difference of pressure between the furnace and the chamber, i.e., 50 torr.

When the temperature of the molten uranium in the furnace, measured by a thermocouple, reaches 1,300° C., the furnace is moved downward by the operation of the hydraulic cylinder located above the chamber so that the distance between the nozzle and the cooling roll is 0.5 mm.

Simultaneously, the molten uranium is discharged at a pressure of 0.5 kg/cm$^2$ from the furnace to the outer circumference of the cooling roll rotated at a high speed of 800 rpm, thereby being formed into a uniform and continuous uranium foil with a length of 45 mm.

The uranium foil formed by the jetting via the slot contacts the outer circumference of the cooling roll, thus being rapidly cooled so that fine uranium crystalline granules with irregular orientation are formed at the room temperature. Accordingly, the method of the present invention does not require a heat treatment process, in which uranium is maintained at a temperature of 800° C. and then quenched so that the crystalline granules of the uranium are fine, conventionally employed to produce a uranium foil by means of hot rolling.

The above foil is collected by the collection tray located close to the chamber. The proper thickness of the produced foil is in the range of 100 $\mu$m to 150 $\mu$m. The recovery rate of the foil with the proper thickness is more than 99%.

Figure 8:
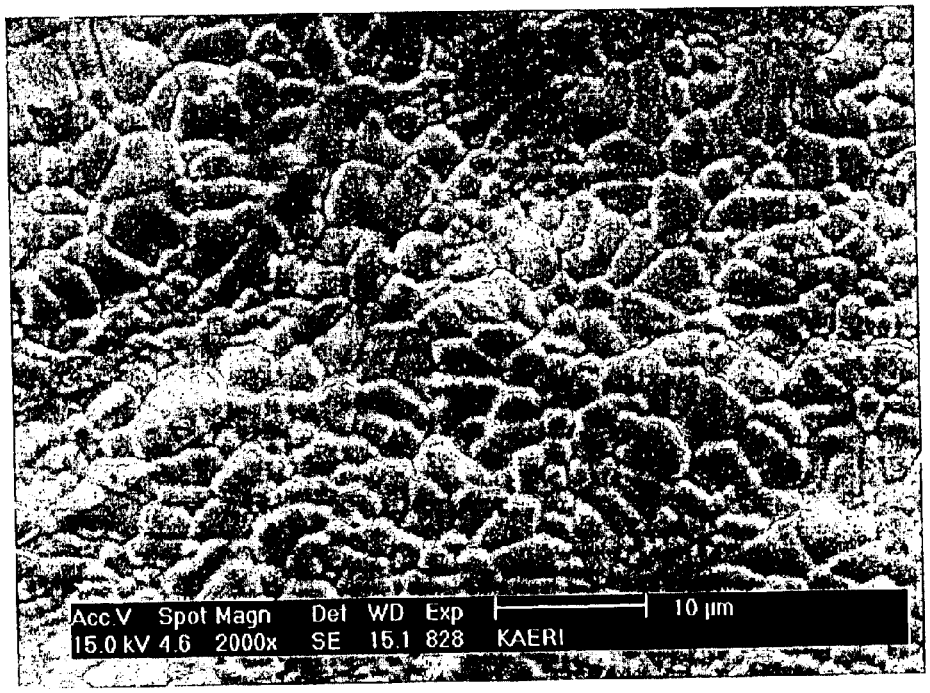
FIG. 8 is a photograph of a uranium foil produced by a first example of the method in accordance with the second embodiment of the present invention, taken by a scanning electron microscope.
Figure 9:
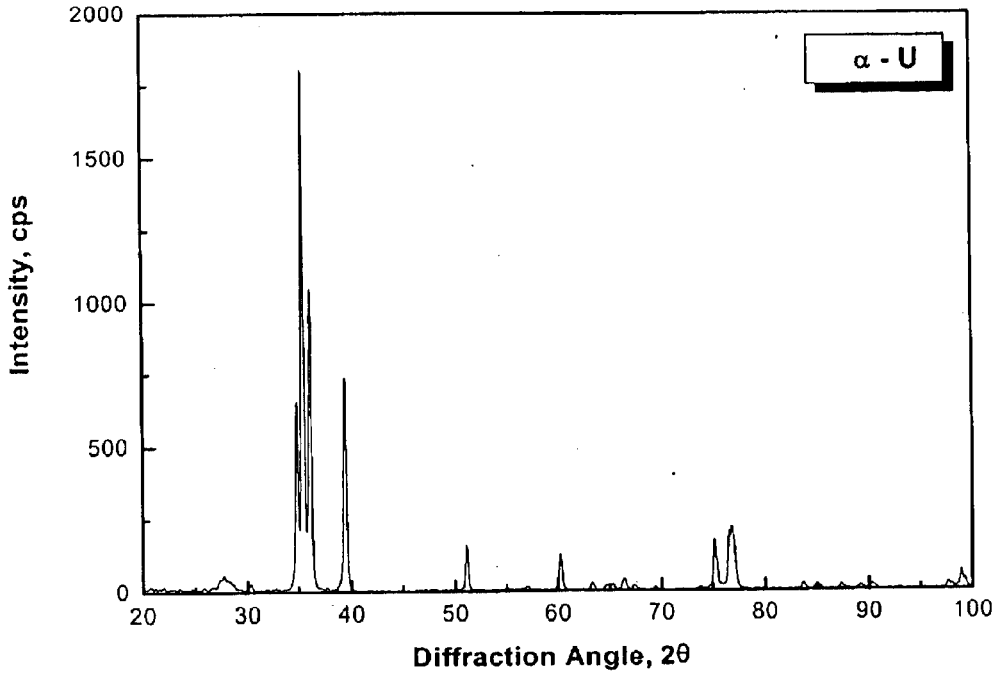
FIG. 9 is a graph illustrating a pattern of the uranium foil produced by the first example of the method in accordance with the second embodiment of the present invention, obtained by X-ray diffraction.

With reference to FIGS. 8 and 9 respectively showing a photograph taken by a scanning electron microscope and a graph obtained by X-ray diffraction, the produced uranium foil is described, as follows.

As shown in FIGS. 8 and 9, the produced uranium foil has an $\alpha$-U phase. The uranium foil has fine and uniform crystalline granules with a size of less than approximately 10 $\mu$m, and its crystalline orientation is irregular.

The produced uranium foil does not have impurities such as oxidized substance, or air voids at its surface.

EXAMPLE 2

Hereinafter, the production of a foil made of uranium alloy containing U—Mo(7 wt. %) is described. The uranium alloy 1 kg is introduced into the furnace with a diameter of 75 mm, made of quartz, and a vacuum is formed within the chamber by the operation of the exhaust pump.

When the degree of vacuum in the chamber reaches $10^{-5}$ torr, the furnace is heated by the high frequency induction coil. Before the uranium alloy is melted, the vacuum in the chamber is broken and the high-purity inert gas is injected into the chamber until the pressure of the chamber and the furnace reaches 600 torr.

Here, in order to prevent the molten uranium alloy from being leaked via the slot with a length of 70 mm and a width of 0.3 mm, the furnace is sealed and the inert gas is further injected into the chamber so that the pressure of the chamber reaches 700 torr. Thus, a counterpressure is generated in the furnace due to the difference of pressure between the furnace and the chamber, i.e., 100 torr.

When the temperature of the molten uranium alloy in the furnace, measured by the thermocouple, reaches 1,350° C., the furnace is moved downward by the operation of the hydraulic cylinder located above the chamber so that the distance between the slot and the cooling roll is 0.8 mm. Simultaneously, the inert gas is injected into the furnace so that the molten uranium alloy is discharged at a pressure of 1.0 kg/cm$^2$ from the furnace to the outer circumference of the cooling roll rotated at a high speed of 500 rpm, thereby being formed into a uniform and continuous uranium foil with a width of 70 mm.

The uranium foil formed by the jetting via the slot contacts the outer circumference of the cooling roll, thus being rapidly cooled so that fine uranium crystalline granules with an isotropic $\gamma$-U phase are formed at the room temperature. Accordingly, the method of the present invention does not require a heat treatment process, in which uranium is maintained at a temperature of 800° C. and then quenched, conventionally employed to produce a uranium foil by means of hot rolling.

The above foil is collected by the collection tray located close to the chamber. The proper thickness of the produced foil is in the range of 200 $\mu$m to 300 $\mu$m. The recovery rate of the foil with the proper thickness is more than 99%.

Figure 10:
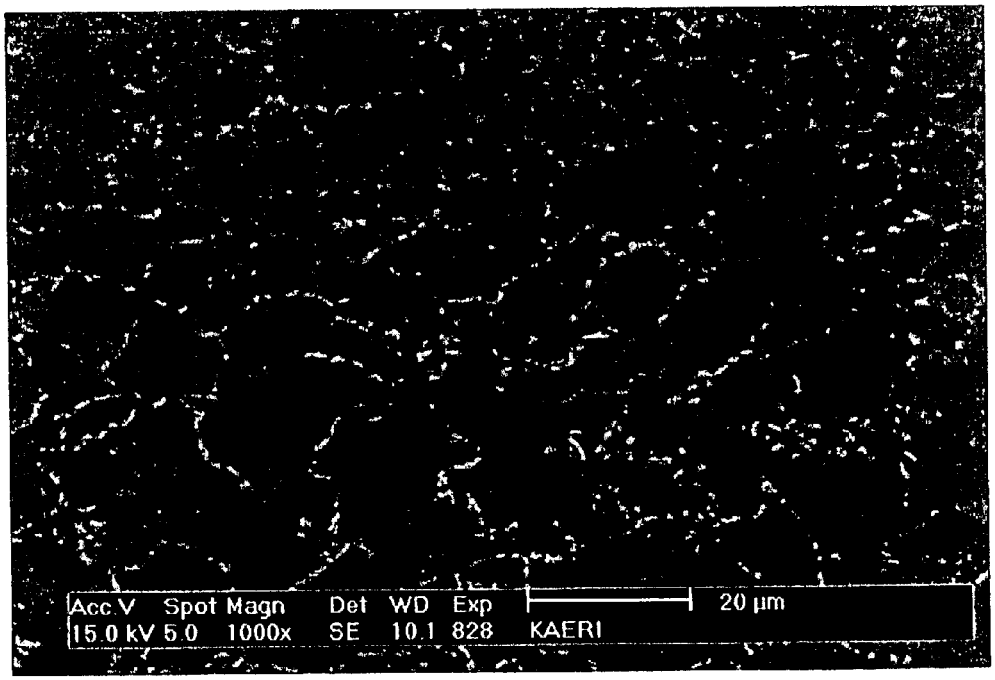
FIG. 10 is a photograph of a uranium foil produced by a second example of the method in accordance with the second embodiment of the present invention, taken by a scanning electron microscope.
Figure 11:
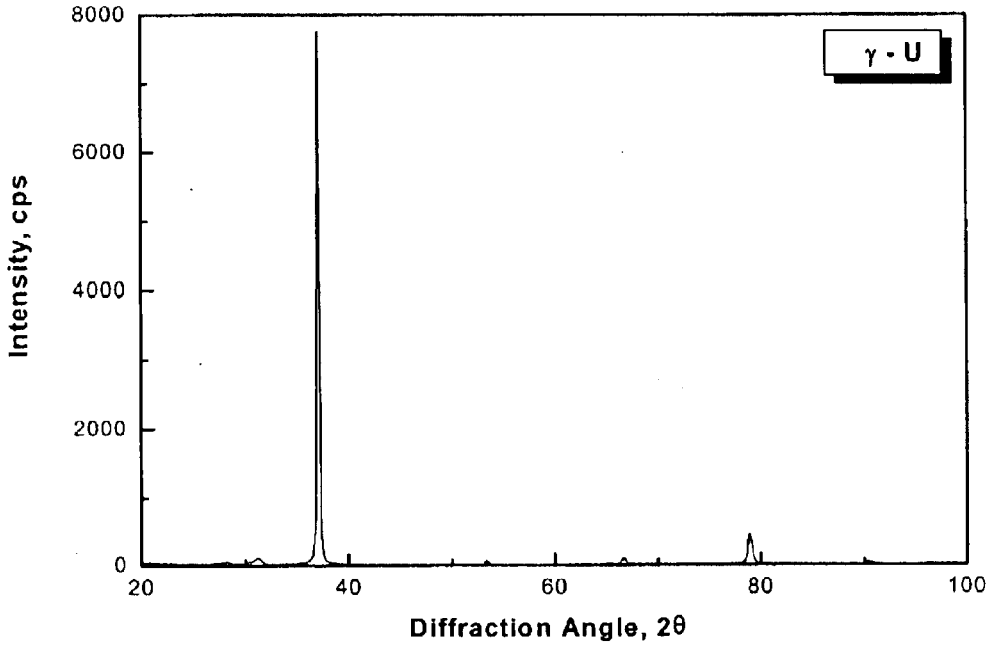
FIG. 11 is a graph illustrating a pattern of the uranium foil produced by the second example of the method in accordance with the second embodiment of the present invention, obtained by X-ray diffraction.

With reference to FIGS. 10 and 11 respectively showing a photograph taken by a scanning electron microscope and a graph obtained by X-ray diffraction, the produced uranium alloy foil is described, as follows.

As shown in FIGS. 10 and 11, the produced uranium alloy foil containing U—Mo(7 wt. %) has the $\gamma$-U phase. The uranium alloy foil has fine and uniform crystalline granules with a size of less than approximately 10 $\mu$m.

The produced uranium alloy foil containing U—Mo(7 wt. %) does not have impurities such as oxidized substance, or air voids at its surface.

As apparent from the above description, the present invention provides a method and an apparatus for producing a uranium foil with fine particles, and a uranium foil produced thereby.

The method for producing the uranium foil of the present invention does not require a vacuum induced melting process for obtaining an ingot of metal including low or high-grade uranium, a hot rolling process repeated several time for obtaining a thin foil, a washing and drying step for removing impurities such as surface oxidized substances, a heat treatment process for obtaining fine and isotropic crystalline granules, thus being simplified compared to the conventional method for producing a foil.

The foil of the present invention is produced by melting uranium or uranium alloy and rapidly cooling the molten uranium or uranium alloy. Accordingly, it is possible to easily produce the foil from uranium, which is rarely rolled.

Compared to the conventional hot rolling process requiring a long time for repeating the process several times so as to adjust the produced uranium ingot, the method of the present invention produces a great quantity of the foil in several minutes by rapidly cooling the molten uranium or uranium alloy, thereby improving the productivity.

The method of the present invention increases the recovery rate of the uranium or uranium alloy to more than 99% and produces several kg of the foil in several minutes, thereby maximizing the recovery rate of the uranium or uranium alloy and the economic efficiency.

Compared to the foil produced by the conventional hot rolling process, the foil of the present invention, produced only by cooling the molten uranium or uranium alloy, does not impart residual stress, thereby being protected from deformation and/or damage due to the thermal cycling during the production or irradiation process.

The foil of the present invention has fine and uniform crystalline granules with irregular orientation, thus generally having an isotropic structure and being less swollen during the irradiation process.

The foil of the present invention has an isotropic $\gamma$-U phase being metastable at room temperature, thereby being used as a nuclear fuel for research reactors, which has fine air voids produced by nuclear fission, and stably moving in the reactors.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for producing a uranium foil, comprising the steps of:

(a) charging a furnace installed in a sealed chamber with uranium alloy, forming a vacuum in the chamber, and heating the chamber by means of a high frequency induction coil so that the uranium alloy is melted in the chamber;

(b) elevating a stopper installed in the furnace so that the molten uranium alloy is discharged from the furnace into a turn dish below the furnace, and gravitationally dropping the molten uranium alloy as a foil shape at a designated speed via a slot of a nozzle installed in a bottom surface of the turn dish;

(c) feeding the foil into a gap between a pair of cooling rolls located below the slot within the chamber and rotated in opposite directions so that both sides of the foil respectively contact the cooling rolls to be rapidly cooled; and (d) collecting the cooled foil by a collection tray located below the cooling rolls at a bottom of the chamber.

2. The method as set forth in claim 1, further comprising, after the step (c), the step of (c') jetting an inert gas to the dropping foil so that the foil is completely cooled under the inert gas atmosphere.

3. The method as set forth in claim 1, wherein a dropping speed of the foil at the step (b) and a rotational speed of the cooling rolls at the step (c) are equal.

4. The method as set forth in claim 1, wherein the molten uranium alloy formed at the step (a) is obtained by overheating the uranium alloy at a temperature higher than the melting temperature of the uranium alloy by at least 200° C.

5. The method as set forth in claim 1, wherein a degree of vacuum of the chamber at the step (a) is more than $10^{-2}$ torr.

6. The method as set forth in claim 1, wherein a width of the slot is in the range of greater than 0 to 1.2 mm.

7. The method as set forth in claim 1, wherein a rotational speed of the cooling rolls is in the range of greater than 0 to 300 rpm.

8. The method as set forth in claim 1, wherein a cooling speed of the foil by means of the cooling rolls at the step (c) is more than $10^{3}$° C./sec.

9. The method as set forth in claim 1, wherein the uranium alloy contains uranium and three elements [U-Q-X-Y], said Q, X, and Y elements being different ones selected from the group consisting of Al, Fe, Ni, S1, Cr, Zr, Mo, and Nb, wherein the Q element is present in an amount of 0 to 10 wt. %, the X element is present in an amount of 0 to 1 wt. %, and the Y element is present in an amount of 0 to 1 wt. %.

10. An apparatus for producing a uranium foil, comprising:

a vacuum unit including:

a hermetically sealed chamber;

an exhaust pump installed at the outside of the chamber; and an exhaust pipe for connecting the chamber and the exhaust pump, said vacuum unit serving to form a vacuum state in the chamber;

a melting and discharging unit including:

a furnace installed within the chamber;

a high frequency induction coil wound around an outer surface of the furnace;

an outlet formed through a bottom of the furnace; and a stopper moving upward and downward so as to open and close the outlet, said melting and discharging unit serving to melt uranium alloy and discharge molten uranium alloy;

a foil forming unit including:

a turn dish located below the furnace correspondingly to the outlet;

a nozzle installed in a bottom of the turn dish; and a slot formed through an end of the nozzle, said foil forming unit serving to cast the molten uranium alloy uniformly supplied from the turn dish into the foil via the slot and to allow the cast foil to be gravitationally dropped at a designated speed;

a contact cooling unit including:

a pair of cooling rolls located below the slot within the chamber and operated at a designated speed so that both sides of the foil cast by the slot respectively contact the two cooling rolls to rapidly cool the foil; and a collection tray located below the cooling rolls at a bottom of the chamber.

11. The apparatus as set forth in claim 10, further comprising a gas-cooling unit for completely cooling the dropping foil after the cooling rolls, including:

a gas jetting nozzle located below the cooling rolls;

a gas supply pipe connected to the gas jetting nozzle for supplying an inert gas to the gas jetting nozzle; and a gas supply valve installed in the gas supply pipe.

12. A method for producing a uranium foil, comprising the steps of:

(a) charging a furnace provided with a nozzle in its bottom with uranium alloy, and heating the furnace under the vacuum condition;

(b) breaking the vacuum in a chamber before the uranium alloy is melted, and filling the chamber and the furnace with an inert gas until the chamber and the furnace reach designated pressures;

(c) sealing the furnace after the chamber and the furnace is completely filled with the inert gas, and additionally injecting inert gas into the chamber so that the chamber has a higher pressure than the furnace to generate a counterpressure in the furnace;

(d) continuously heating the uranium alloy during the maintaining of the counterpressure so as to form completely molten uranium alloy up to a designated temperature, and moving the furnace downward so that a slot approaches the outer circumference of a cooling roll rotated at a designated speed;

(e) injecting inert gas into the furnace so that the counterpressure in the furnace is broken after the slot approaches the cooling roll, and discharging the molten uranium alloy to the outer circumference of the cooling roll at a uniform pressure via the slot so as to cast the molten uranium alloy into a foil via the slot;

(f) rotating the cooling roll and the foil thereon so that the foil is rapidly cooled after one side of the foil formed from the molten uranium alloy discharged via the slot contacts the outer circumference of the cooling roll; and (g) feeding the cooled and solidified foil into a collection tray located close to the cooling roll.

13. The method as set forth in claim 12, wherein the uranium alloy contains uranium and three elements [U-Q-X-Y], said Q, X, and Y elements being different ones selected from the group consisting of Al, Fe, Ni, Si, Cr, Zr, Mo, and Nb, wherein the Q element is present in an amount of 0 to 10 wt. %, the X element is present in an amount of 0 to 1 wt. %, and the Y element is present in an amount of 0 to 1 wt. %.

14. The method as set forth in claim 12, wherein a degree of vacuum in the chamber at the step (a) is in the range of $10^{-3}$~$10^{-5}$ torr, a pressure in the chamber at the step (b) is 600 torr, and a pressure in the chamber at the step of (c) is 700 torr, and wherein at the steps (d) and (e), a temperature of the molten uranium alloy is in the range of 1,150 to 1,400° C., a width of the nozzle is in the range of 0.3 to 1.0 mm, a blast pressure of the molten uranium alloy via the slot of the nozzle is in the range of 0.2 to 2.0 kg/cm$^2$, a distance between the nozzle and the cooling roll is in the range of 0.4 to 1.0 mm, and a rotational speed of the cooling roll is in the range of 200 to 1,200 rpm.

15. The method as set forth in claim 12, wherein a degree of vacuum in the chamber at the step (a) is in the range of $10^{-3}$~$10^{-5}$ torr, a pressure in the chamber at the step (b) is in the range of 400 to 730 torr, and a pressure in the chamber at the step of (c) is 430 to 760 torr, and wherein at the steps (d) and (e), a temperature of the molten uranium alloy is in the range of 1,150 to 1,400° C., a width of the nozzle is in the range of 0.3 to 1.0 mm, a blast pressure of the molten uranium alloy via the slot of the nozzle is in the range of 0.2 to 2.0 kg/cm$^2$, a distance between the nozzle and the cooling roll is in the range of 0.4 to 1.0 mm, and a rotational speed of the cooling roll is in the range of 200 to 1,200 rpm.

16. The method as set forth in claim 12, prior to the step (a), further comprising the step of (a') moving the furnace downward so that the slot contacts the outer circumference of the cooling roll, said position of the slot being designated as the zero point, and moving the furnace upward from the zero point so that the slot is located close to the cooling roll, said position of the slot being used as a predetermined proximal position.

17. The method as set forth in claim 12, wherein a difference of pressure between the furnace and the chamber at the step (c) is in the range of 30 to 300 torr.

18. The method as set forth in claim 12, wherein a degree of vacuum in the chamber at the step (a) is in the range of $10^{-3}$ to $10^{-5}$ torr.

19. The method as set forth in claim 12, wherein a temperature of the molten uranium alloy is in the range of 1,150 to 1,400° C.

20. The method as set forth in claim 12, wherein a width of the slot is in the range of 0.3 to 1.0 mm.

21. The method as set forth in claim 12, wherein a blast pressure of the molten uranium alloy via the slot is in the range of 0.2 to 2.0 kg/cm$^2$.

22. The method as set forth in claim 12, wherein a distance between the slot and the cooling roll is in the range of 0.3 to 1.0 mm.

23. The method as set forth in claim 12, wherein a rotational speed of the cooling roll is in the range of 200 to 1,200 rpm.

24. An apparatus for producing a uranium foil, comprising:

a vacuum unit including:
- a hermetically sealed chamber;
- an exhaust pump installed at the outside of the chamber; and
- an exhaust pipe for connecting the chamber and the exhaust pump, said vacuum unit serving to form a vacuum state in the chamber;

a melting and discharging unit including:
- a furnace installed within the chamber;
- a nozzle integrally formed at a bottom of the furnace;
- a slot formed at an end of the nozzle; and
- a high frequency induction coil wound around an outer surface of the furnace;

a contact cooling unit including a cooling roll positioned below the slot within the chamber and rotated at a designated speed so that one side of the foil formed from the molten uranium alloy discharged via the slot contacts the outer circumference of the cooling roll;

a moving unit for moving the furnace upward and downward so that the slot is close to the cooling roll;

a sealing unit located between the moving unit and the furnace for hermetically sealing and fixing the furnace;

a counterpressure generating unit including:
- a gas feed pipe connected to the chamber and provided with a gas supply valve; and
- a furnace flow pipe connected to the chamber and the furnace via the sealing unit and provided with a switching valve; and a jetting unit including a gas injection pipe branched from the furnace flow pipe and provided with a gas injection valve.

25. The apparatus as set forth in claim 24, wherein the moving unit includes:
- a sliding rod connected to the sealing unit and vertically inserted into the chamber;
- a hydraulic cylinder fixed to an end of the sliding rod; and
- a fixing plate installed at the outside of the chamber so as to fix the hydraulic cylinder.

26. The apparatus as set forth in claim 25, wherein the moving unit further includes:
- a spiral rotary shaft rotatably connected to the fixing plate so that the sliding rod accurately moves;
- a worm gear engaged with the spiral rotary shaft; and
- a knob installed at one side of the worm gear for rotating the worm gear.

27. The apparatus as set forth in claim 24, wherein the furnace and the nozzle are made of transparent quartz, and a window is formed through the surface of the chamber so as to correspond to the furnace.

28. The apparatus as set forth in claim 24, further comprising a collecting unit including:
- a blade made of Teflon contacting the outer circumference of the cooling roll;
- a guide plate for supporting the blade; and
- a collection tray located close to the guide plate so as to be connected to the chamber and sealed.

29. The apparatus as set forth in claim 24, further comprising a jetting angle control unit including:
- a guide rail positioned between the sealing unit and the moving unit so as to horizontally move the sealing unit, and provided with a feed screw; and
- a guide block located below the guide rail and moved by the rotation of the feed screw.

* * * * *